US012253315B2

(12) United States Patent
Nakano et al.

(10) Patent No.: US 12,253,315 B2
(45) Date of Patent: Mar. 18, 2025

(54) AIR CONDITIONER

(71) Applicant: DAIKIN INDUSTRIES, LTD., Osaka (JP)

(72) Inventors: Hiroyuki Nakano, Osaka (JP); Shota Ago, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/693,336

(22) PCT Filed: May 23, 2022

(86) PCT No.: PCT/JP2022/021142
§ 371 (c)(1),
(2) Date: Mar. 19, 2024

(87) PCT Pub. No.: WO2023/053568
PCT Pub. Date: Apr. 6, 2023

(65) Prior Publication Data

US 2024/0263895 A1 Aug. 8, 2024

(30) Foreign Application Priority Data

Sep. 30, 2021 (JP) ..... 2021-161628

(51) Int. Cl.
*F28F 19/06* (2006.01)
*F24F 1/0003* (2019.01)
(Continued)

(52) U.S. Cl.
CPC ..... *F28F 19/06* (2013.01); *F24F 1/0059* (2013.01); *F24F 1/14* (2013.01); *F24F 1/0003* (2013.01)

(58) Field of Classification Search
CPC ..... F24F 1/0003; F24F 1/14; F24F 1/0059; F24F 1/0035; F24F 1/0067; F28F 19/06;
(Continued)

(56) References Cited

U.S. PATENT DOCUMENTS

| | | | |
|---|---|---|---|
| 9,964,367 | B2 | 5/2018 | Kimata et al. |
| 2016/0195335 | A1 | 7/2016 | Nishiyama et al. |
| 2019/0024923 | A1 | 1/2019 | Ito |

FOREIGN PATENT DOCUMENTS

| | | | | |
|---|---|---|---|---|
| CN | 112728642 A | * | 4/2021 | ..... F24F 1/0007 |
| JP | 11-108480 A | | 4/1999 | |

(Continued)

OTHER PUBLICATIONS

International Search Report (PCT/ISA/210) issued in PCT/JP2022/021142, dated Jun. 1, 2022.

(Continued)

*Primary Examiner* — Harry E Arant
(74) *Attorney, Agent, or Firm* — Birch, Stewart, Kolasch & Birch, LLP

(57) ABSTRACT

An air conditioner 1 is disclosed as an air conditioner configured to condition air by connecting an indoor unit 2 including a first heat exchanger 11 in which a refrigerant exchanging heat with room air flows to an outdoor unit 3 including a second heat exchanger 24 in which a refrigerant exchanging heat with outdoor air flows. The first heat exchanger 11 includes a first heat transfer tube 11*a*1 made of aluminum or aluminum alloy, and the second heat exchanger 24 includes a second heat transfer tube 24*a* made of aluminum or aluminum alloy. A first sacrificial layer 45*a* is formed on an outer circumferential surface of the first heat transfer tube 11*a*1, and a second sacrificial layer 35 is formed on an outer circumferential surface of the second heat transfer tube 24*a*. The maximum thickness to of the second sacrificial layer 35 is larger than the sacrificial layer ti1 of the first sacrificial layer 45*a*. This suppresses corrosion of the heat transfer tube of the outdoor unit.

17 Claims, 9 Drawing Sheets

(51) Int. Cl.
*F24F 1/0059* (2019.01)
*F24F 1/14* (2011.01)

(58) Field of Classification Search
CPC ..... F28F 19/004; F28F 21/084; F28F 21/089; F28F 1/06; F25B 47/00; F25B 41/24; F25B 13/00; F25B 39/00; F25B 2347/00; F28D 1/0477; F28D 2021/0068
See application file for complete search history.

(56) References Cited

FOREIGN PATENT DOCUMENTS

| | | | | |
|---|---|---|---|---|
| JP | 2010-197017 | A | | 9/2010 |
| JP | 2013-2682 | A | | 1/2013 |
| JP | 2014-95524 | A | | 5/2014 |
| JP | 2014095524 | A | * | 5/2014 |
| JP | 2018-61935 | A | | 4/2018 |
| JP | 2020-56572 | A | | 4/2020 |
| JP | 2021-18024 | A | | 2/2021 |
| WO | WO 2015/004719 | A1 | | 1/2015 |
| WO | WO 2017/081786 | A1 | | 5/2017 |

OTHER PUBLICATIONS

International Preliminary Report on Patentability and English translation of the Written Opinion of the International Searching Authority for International Application No. PCT/JP2022/021142, dated Apr. 2, 2024.
Extended European Search Report for European Application No. 22875448.7, dated Dec. 4, 2024.

* cited by examiner

AIR CONDITIONER

TECHNICAL FIELD

The present disclosure relates to an air conditioner.

BACKGROUND

In an air conditioner, aluminum or aluminum alloy has recently been used as a material of a refrigerant pipe including a heat transfer tube of a heat exchanger. Aluminum and aluminum alloy are easily corroded. Therefore, in order to suppress the leakage of a refrigerant due to the corrosion, a sacrificial layer (an anti-corrosion layer) including zinc, etc. may be provided on an outer circumference of a heat transfer tube. In this regard, the electric potential of zinc is lower than that of aluminum. In Patent Literature 1, the thickness of an anti-corrosion layer provided at the thinnest part of a heat transfer tube of an indoor unit is larger than that of an anti-corrosion layer provided at the thinnest part of a refrigerant pipe of an outdoor unit in order to suppress the leakage of a refrigerant into a room where the refrigerant easily stagnates.

CITATION LIST

Patent Literatures

[Patent Literature 1] Japanese Laid-Open Patent Publication No. 2020-56572

SUMMARY OF THE INVENTION

Technical Problem

It has been known that the corrosion of aluminum is accelerated by chlorine. Typically, the salt content of outdoor air tends to be higher than that of room air. Because of this, the heat transfer tube of the outdoor unit may be corroded in Patent Literature 1. In this regard, the heat transfer tube is made of aluminum or aluminum alloy.

An object of the present disclosure is to provide an air conditioner configured to suppress the corrosion of a heat transfer tube of an outdoor unit.

Solution to Problem

An air conditioner of the present disclosure is configured to condition air by connecting an indoor unit including a first heat exchanger, in which a refrigerant exchanging heat with room air flows, to an outdoor unit including a second heat exchanger in which a refrigerant exchanging heat with outdoor air flows. The first heat exchanger includes a first heat transfer tube made of aluminum or aluminum alloy, and the second heat exchanger includes a second heat transfer tube made of aluminum or aluminum alloy. A first sacrificial layer is formed on an outer circumferential surface of the first heat transfer tube, a second sacrificial layer is formed on an outer circumferential surface of the second heat transfer tube, and the maximum thickness of the second sacrificial layer is larger than the maximum thickness of the first sacrificial layer.

According to the present disclosure, corrosion is suppressed at the second heat transfer tube which is included in the second heat exchanger and through which the outdoor air passes. In this regard, the salt content of the outdoor air is high.

In the above-described air conditioner, the wall thickness of the first heat transfer tube is preferably smaller than the wall thickness of the second heat transfer tube. Because the thickness of the first sacrificial layer is smaller than that of the second sacrificial layer, (i) the necessary thickness of a base material is secured and (ii) the wall thickness of the first heat transfer tube which is a combination of the first sacrificial layer and the base material is small. This improves the efficiency of heat conduction in the first heat exchanger.

In the above-described air conditioner, an inner diameter of the first heat transfer tube is preferably larger than an inner diameter of the second heat transfer tube. This reduces the pressure drop of a refrigerant in the first heat exchanger.

In the above-described air conditioner, an outer diameter of the first heat transfer tube is preferably smaller than an outer diameter of the second heat transfer tube. This suppresses the increase in resistance of air passing through the first heat exchanger.

In the above-described air conditioner, the first sacrificial layer and the second sacrificial layer are preferably made of zinc or alloy including zinc. With this arrangement, a good sacrifice anti-corrosion effect is obtained.

In the above-described air conditioner, the maximum thickness of the first sacrificial layer may be 0.12 mm or more.

In the above-described air conditioner, the maximum thickness of the second sacrificial layer may be 0.17 mm or more.

In the above-described air conditioner, (i) the first heat transfer tube may be formed of: a base material made of aluminum or aluminum alloy; and the first sacrificial layer, (ii) the second heat transfer tube may be formed of another base material made of aluminum or aluminum alloy; and the second sacrificial layer, and (iii) each of the first heat transfer tube and the second heat transfer tube may be formed of a clad material. This suppresses the thickness variation of each sacrificial layer.

In the above-described air conditioner, (i) the first heat transfer tube may be formed of: a base material made of aluminum or aluminum alloy; and the first sacrificial layer, (ii) the second heat transfer tube may be formed of: another base material made of aluminum or aluminum alloy; and the second sacrificial layer, and (iii) each of the first sacrificial layer and the second sacrificial layer may be a diffuse layer made of aluminum-zinc alloy. With this arrangement, each sacrificial layer is relatively easily formed by spraying zinc on a corresponding base material.

The above-described air conditioner may further include an air supply duct configured to allow the outdoor air to flow toward the indoor unit, the first heat exchanger may further include a third heat transfer tube made of aluminum or aluminum alloy, a third sacrificial layer may be formed on an outer circumferential surface of the third heat transfer tube, the maximum thickness of the third sacrificial layer may be larger than the maximum thickness of the first sacrificial layer, and the third heat transfer tube may be closer to an opening of the air supply duct than the first heat transfer tube is to the opening. With this arrangement, the corrosion is suppressed at the third heat transfer tube through which a refrigerant exchanging heat with air flows. The air is blown out from the air supply duct, and has a high salt content.

In the above-described air conditioner, the wall thickness of the first heat transfer tube is preferably smaller than the wall thickness of the third heat transfer tube. Because the thickness of the first sacrificial layer is smaller than that of the third sacrificial layer, (i) the necessary thickness of a base material is secured and (ii) the wall thickness of the first heat transfer tube which is a combination of the first sacrificial layer and the base material is small. This improves the efficiency of heat conduction in an area of the first heat transfer tube of the first heat exchanger.

In the above-described air conditioner, the inner diameter of the first heat transfer tube is preferably larger than an inner diameter of the third heat transfer tube. This reduces the pressure drop of a refrigerant in the area of the heat transfer tube of the first heat exchanger.

In the above-described air conditioner, the outer diameter of the first heat transfer tube is preferably smaller than an outer diameter of the third heat transfer tube. This suppresses the increase in resistance of air passing through the area of the first heat transfer tube of the first heat exchanger.

In the above-described air conditioner, the maximum thickness of the third sacrificial layer may be the same as the maximum thickness of the second sacrificial layer. With this arrangement, the corrosion is suppressed at the third heat transfer tube to the same degree as at the second heat transfer tube.

In the above-described air conditioner, the second sacrificial layer, the third sacrificial layer, and the first sacrificial layer in this order may be the largest, the second largest, and the third largest in maximum thickness. With this arrangement, the higher the salt content of air with which a heat transfer tube exchanges heat is, the larger the thickness of a sacrificial layer formed on this heat transfer tube is.

In the above-described air conditioner, preferably, a coating is formed on a first fin in contact with the outer circumferential surface of the first heat transfer tube, and another coating is formed on a second fin in contact with the outer circumferential surface of the second heat transfer tube. With this arrangement, each fin has the corrosion resistance.

In the above-described air conditioner, the thickness of the another coating formed on the second fin is preferably larger than the thickness of the coating formed on the first fin. This improves the corrosion resistance of the second fin with which the outdoor air makes contact.

PREFERRED EMBODIMENT OF INVENTION

First Embodiment

Figure 1:
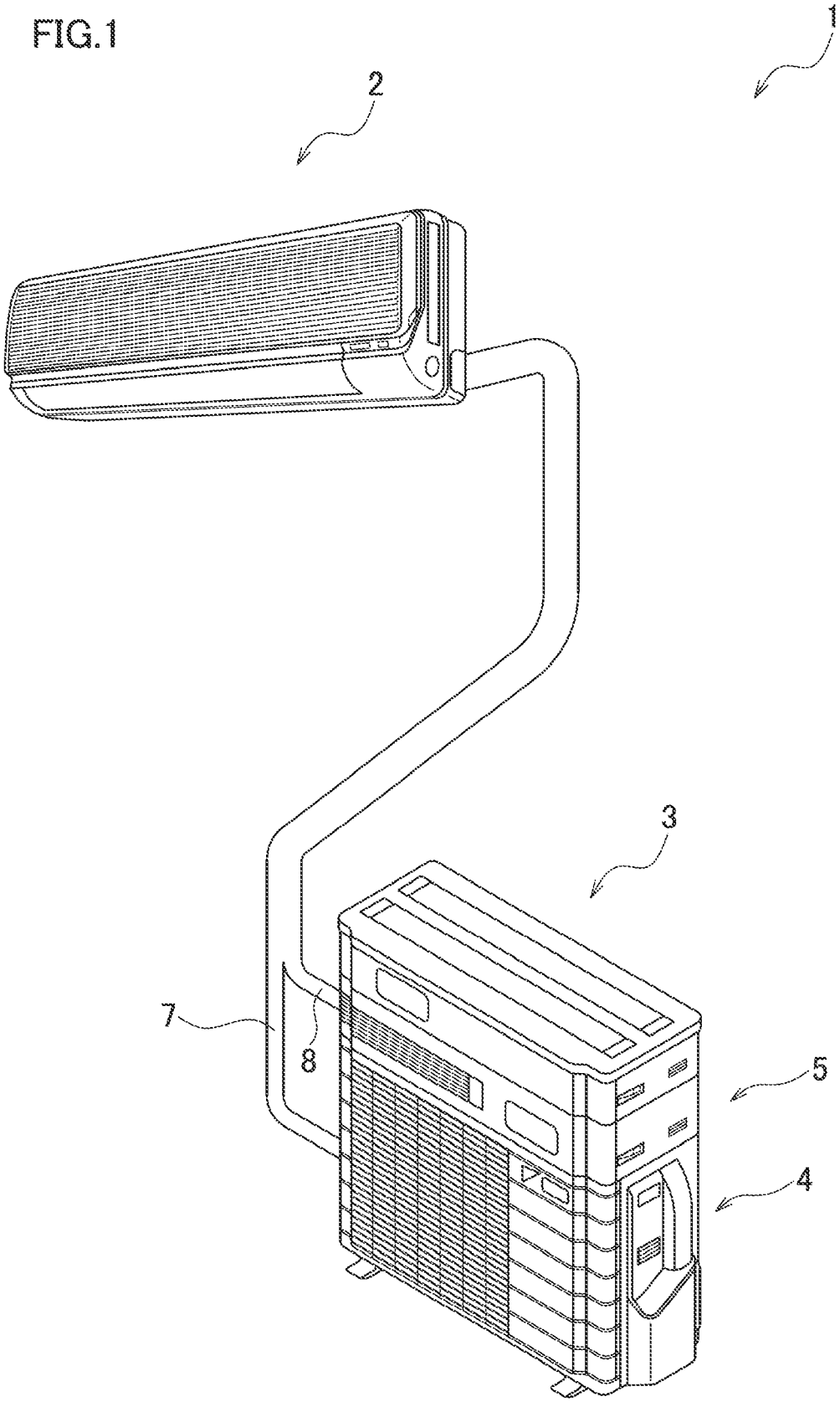
FIG. 1 shows an external view of an air conditioner of First Embodiment of the present disclosure.

The following will describe an air conditioner 1 of First Embodiment of the present disclosure. As shown in FIG. 1, the air conditioner 1 includes an indoor unit 2 attached to a wall surface, etc. of a room and an outdoor unit 3 installed outside the room. The outdoor unit 3 includes an outdoor refrigerant unit 4 and a humidification unit 5. The indoor unit 2 is connected to the outdoor refrigerant unit 4 through a refrigerant pipe 7 so that a refrigerant circuit is formed. The indoor unit 2 is connected to the humidification unit 5 through an air supply duct 8 used for supplying heated air or humid air to the indoor unit 2. The heated air and the humid air are generated in the humidification unit 5.

Figure 2:
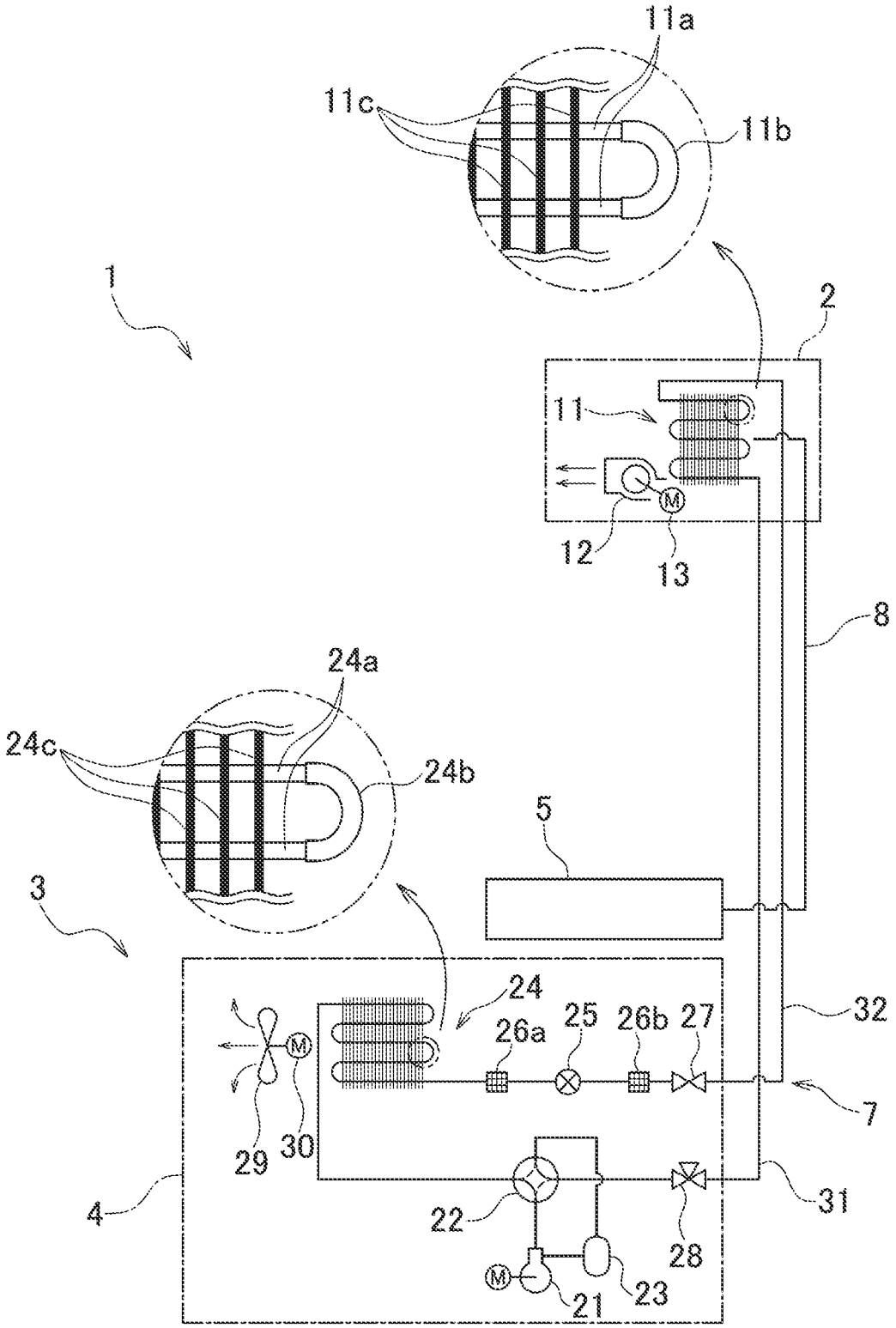
FIG. 2 is a schematic structure diagram of the air conditioner shown in FIG. 1.

As shown in FIG. 2, the outdoor refrigerant unit 4 includes: a compressor 21; a four-pass switching valve 22 which is connected to the discharging port of the compressor 21; an accumulator 23 which is connected to the sucking port of the compressor 21; an outdoor heat exchanger 24 connected to the four-pass switching valve 22; and an electric expansion valve 25 connected to the outdoor heat exchanger 24. The outdoor heat exchanger 24 is a cross-fin-tube-type heat exchanger panel which includes an outdoor piping section and plural fins 24*c*. The outdoor piping section is formed of: plural heat transfer tubes 24*a*; and a U-bend 24*b* which is a connecting pipe connecting end portions of the heat transfer tubes 24*a* to one another. In the present embodiment, each heat transfer tube 24*a* is a straight pipe. However, each heat transfer tube 24*a* may be a hairpin tube including two straight pipe portions and a U-shaped portion connecting these two straight pipe portions. Each fin 24*c* is a flat-plate member, and penetrated by the heat transfer tubes 24*a*. Each fin 24*c* is in contact with outer circumferential surfaces of the heat transfer tubes 24*a*. Each heat transfer tube 24*a* (see FIG. 4A) is formed of: a base material 34 made of aluminum or aluminum alloy; and a sacrificial layer 35 made of zinc or alloy including zinc. The sacrificial layer 35 is formed on an outer circumferential surface of the base material 34. Each fin 24*c* is made of aluminum or aluminum alloy, and a later-described coating is formed on its surface.

The electric expansion valve 25 is connected to the outdoor heat exchanger 24 through a filter 26*a*, connected to a communication pipe 32 through a filter 26*b* and a liquid stop valve 27, and connected to one end of an indoor heat exchanger 11 through this communication pipe 32. The four-pass switching valve 22 is connected to a communication pipe 31 through a gas stop valve 28, and connected to the other end of the indoor heat exchanger 11 through this communication pipe 31. Each of these communication pipes 31 and 32 is equivalent to the refrigerant pipe 7 shown in FIG. 1 and FIG. 2. In the outdoor refrigerant unit 4, an outdoor fan 29 is provided for discharging air having been subjected to heat exchange in the outdoor heat exchanger 24 to the outside. The outdoor fan 29 is a propeller fan which is rotationally driven by an outdoor fan motor 30. In the outdoor heat exchanger 24, the heat exchange occurs between (i) a refrigerant flowing in each heat transfer tube 24*a* through the compressor 21 or the electric expansion valve 25 and (ii) air making contact with each heat transfer tube 24*a* and each fin 24*c*.

The indoor heat exchanger 11 connected to the communication pipes 31 and 32 is provided in the indoor unit 2. The indoor heat exchanger 11 is a cross-fin-tube-type heat exchanger panel which includes an indoor piping section and plural fins 11*c*. The indoor piping section is formed of: plural heat transfer tubes 11*a*; and a U-bend 11*b* which is a connecting pipe connecting end portions of the heat transfer tubes 11*a* to one another. In the present embodiment, each heat transfer tube 11*a* is a straight pipe. However, each heat transfer tube 11*a* may be a hairpin tube including two straight pipe portions and a U-shaped portion connecting these two straight pipe portions. Each fin 11*c* is a flat-plate member, and penetrated by the heat transfer tubes 11*a*. Each fin 11*c* is in contact with outer circumferential surfaces of the heat transfer tubes 11*a*. Each heat transfer tube 11*a* (see FIGS. 4B and 4C) is formed of: a base material 44*a* or 44*b* made of aluminum or aluminum alloy; and a sacrificial layer 45*a* or 45*b* made of zinc or alloy including zinc. Each of the sacrificial layer 45*a* and 45*b* is formed on an outer circumferential surface of the base material 44*a* or 44*b*. Each fin 11*c* is made of aluminum or aluminum alloy, and a later-described coating is formed on its surface. In the indoor heat exchanger 11, the heat exchange occurs between (i) a refrigerant which is supplied from the outdoor refrigerant unit 4 through the refrigerant pipe 7 and which flows in each heat transfer tube 11*a* and (ii) air making contact with each heat transfer tube 11*a* and each fin 11*c*.

An indoor fan 12 and an indoor fan motor 13 configured to rotationally drive the indoor fan 12 are provided in the indoor unit 2. The indoor fan 12 is a cross-flow fan which is cylindrical in shape and on a circumferential surface of which a large number of blades are provided. The indoor fan 12 is configured to generate an air flow in a direction intersecting with its rotational axis. The indoor fan 12 is configured to allow room air to be sucked into the indoor unit 2 from a main air inlet 6*a* and an auxiliary air inlet 6*b* and to blow out, from an outlet 9, air having exchanged heat with the refrigerant flowing in each heat transfer tube 11*a* of the indoor heat exchanger 11.

Figure 3:
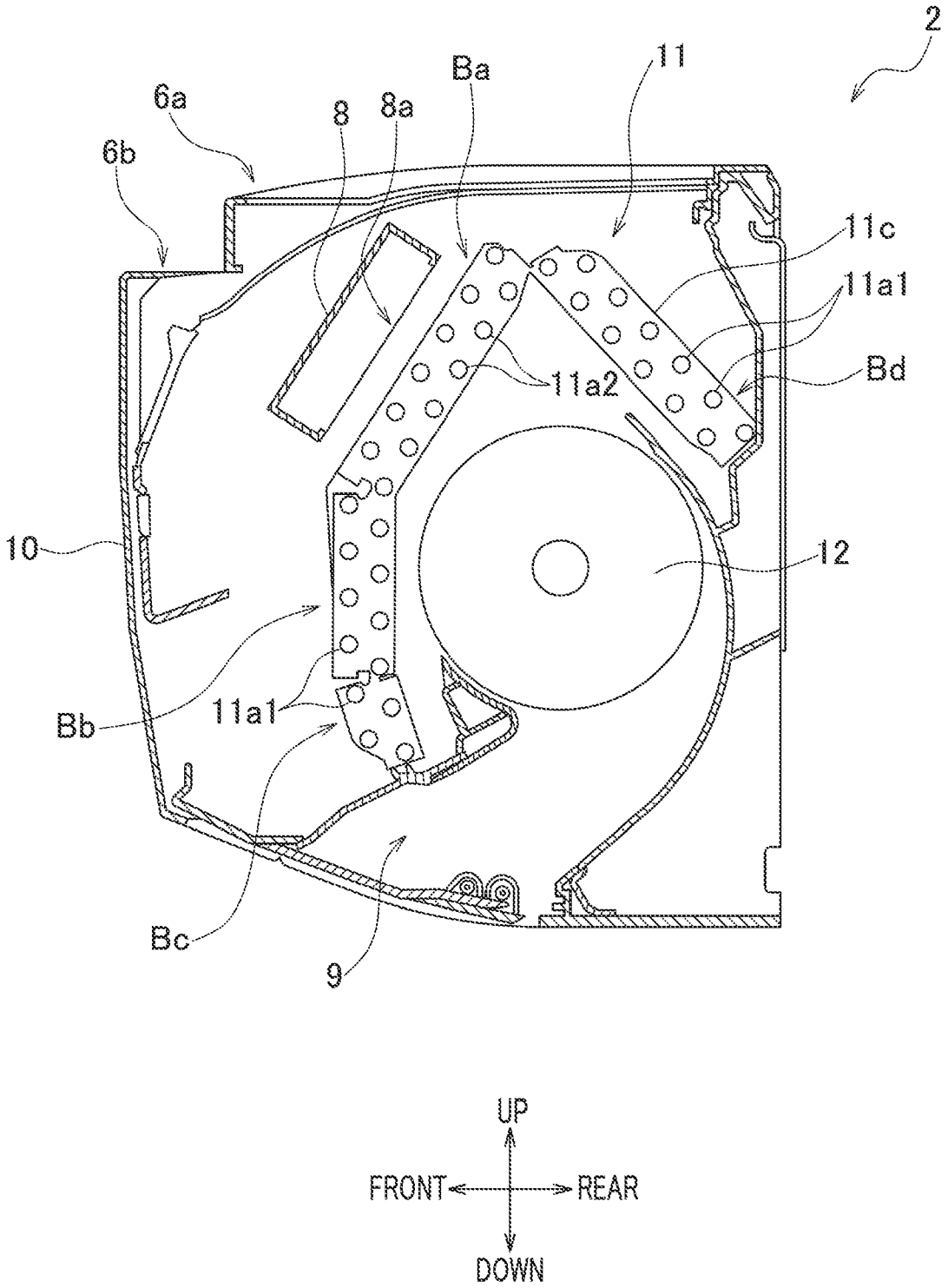
FIG. 3 is a cross section of an indoor unit shown in FIG. 1.

In the present embodiment, the indoor heat exchanger 11 is divided into four parts shown in FIG. 3, i.e., a front-surface upper part Ba, a front-surface intermediate part Bb, a front-surface lower part Bc, and a back-surface part Bd. These four parts Ba, Bb, Bc, and Bd are connected to one another by a connecting pipe through which the refrigerant passes. In the indoor heat exchanger 11, an upper end portion of the front-surface upper part Ba is close to an upper end portion of the back-surface part Bd, the front-surface upper part Ba is positioned so that its lower end portion is provided in front of its upper end portion, and the back-surface part Bd is positioned so that its lower end portion is provided behind its upper end portion. With these arrangements, the indoor heat exchanger 11 is inverse V-shaped in a side view. The front-surface intermediate part Bb vertically extends, and the front-surface lower part Bc is inclined so that its lower end portion is provided behind its upper end portion. As shown in FIG. 3, plural straight pipes equivalent to heat transfer tubes are provided to form two lines in each of the four parts Ba, Bb, Bc, and Bd. The two lines each formed of the straight pipes are located on the upstream and downstream of the airflow, respectively, to the indoor fan 12. In the present embodiment, the up-down direction and front-rear direction of the indoor unit 2 are defined as those shown in FIG. 3.

The humidification unit 5 is provided on the outdoor refrigerant unit 4. The humidification unit 5 includes a moisture-absorbing rotor, a heater assembly, a humiliation fan, and an absorption fan (all of those are not shown). The humidification unit 5 is configured to take in outdoor air and to generate the heated air or humid air. The generated heated air or humid air is supplied to the indoor unit 2 through the air supply duct 8. In the present embodiment, a part of salt such as a chlorine compound and a chlorine ion included in the outdoor air is removed from the air by a heating process or a humidifying process of the humidification unit 5.

As shown in FIG. 3, the air supply duct 8 extends horizontally between a front panel 10 and the front-surface upper part Ba of the indoor heat exchanger 11 in the indoor unit 2. An opening 8*a* which is an outlet of the air supply duct 8 is provided in the indoor unit 2 so as to face the front-surface upper part Ba of the indoor heat exchanger 11. With this arrangement, the heated air or humid air blown out from the opening 8*a* flows toward the front-surface upper part Ba of the indoor heat exchanger 11. The heated air or humid air supplied from the humidification unit 5 is blown out from the opening 8*a* into the indoor unit 2, and then blown out from the outlet 9 into a room by the indoor fan 12 along with the room air sucked from the main air inlet 6*a* and the auxiliary air inlet 6*b*. In the indoor unit 2 of the present embodiment, the length of the air supply duct 8 and the opening 8*a* in a width direction (a direction orthogonal to the plane of FIG. 3) of the indoor unit 2 is smaller than that of the indoor heat exchanger 11 in the width direction. To be more specific, the former length is ⅓ to ¼ of the latter length. Therefore, only a part of the front-surface upper part Ba in the width direction faces the opening 8*a* of the air supply duct 8, and the remaining part of the front-surface upper part Ba in the width direction does not face the opening 8*a* of the air supply duct 8. Because a part of the salt included in the outdoor air is removed in the humidification unit 5 as described above, the salt content of the heated air or humid air blown out from the opening 8*a* of the air supply duct 8 is lower than that of the outdoor air and higher than that of the room air.

In the present embodiment, the heat transfer tubes 11*a* of the indoor heat exchanger 11 are divided into two groups depending on the thickness of a sacrificial layer formed on the outer circumferential surface of each heat transfer tube 11*a*. The first group is formed of heat transfer tubes 11*a*1 included in the front-surface intermediate part Bb, the front-surface lower part Bc, and the back-surface part Bd. The second group is formed of heat transfer tubes 11*a*2 included in the front-surface upper part Ba. The heat transfer tubes 11*a*2 of the second group are closer to the opening 8*a* of the air supply duct 8 than the heat transfer tubes 11*a*1 of the first group are to the opening 8*a*. In this regard, whether each heat transfer tube is close to the opening 8*a* of the air supply duct 8 is determined by comparing parts of heat transfer tubes with one another. A part of each transfer tube (a part of each heat transfer tube, which overlaps the opening 8*a* in the width direction (i.e., a longitudinal direction of each heat transfer tube) of the indoor unit 2 of the present embodiment) is closer to the opening 8*a* than the remaining part of each heat transfer tube is to the opening 8*a*. As described below, the thickness of a sacrificial layer formed on an outer circumferential surface of each heat transfer tube 11*a*2 of the second group is larger than that of a sacrificial layer formed on an outer circumferential surface of each heat transfer tube 11*a*1 of the first group.

The following will detail (i) each heat transfer tube 24*a* of the outdoor heat exchanger 24 and (ii) each heat transfer tube 11*a* of the indoor heat exchanger 11 (heat transfer tube 11*a*1 of the first group, heat transfer tube 11*a*2 of the second group) in the present embodiment.

Figure 4A:
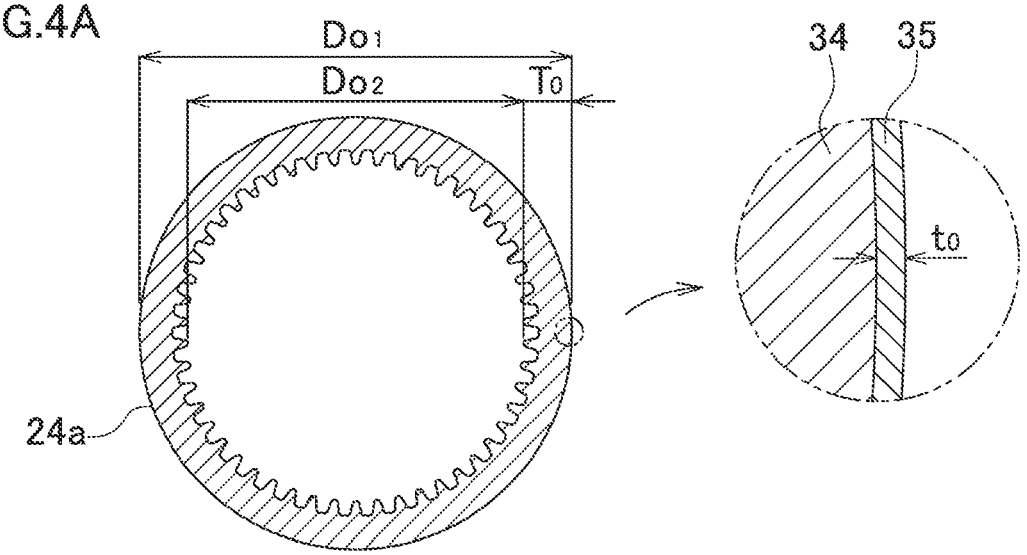
FIG. 4A is a cross section and partial enlarged view of a heat transfer tube (second heat transfer tube) of an outdoor heat exchanger.

As shown in FIG. 4A, each heat transfer tube 24*a* of the outdoor heat exchanger 24 is a cylindrical tube with an outer diameter Do1 and an inner diameter Do2. In order to suppress the increase of channel resistance of a refrigerant and to improve the performance of heat conductivity, an inner circumferential surface of the heat transfer tube 24*a* is an uneven surface on which ribs extend along the longitudinal direction of the heat transfer tube 24*a*. As shown in the partial enlarged view, the heat transfer tube 24*a* is formed of: the base material 34 made of aluminum or aluminum alloy; and the sacrificial layer 35 which is made of zinc or alloy including zinc and which is formed on the outer circumferential surface of the base material 34. The electric potential of metal forming the sacrificial layer 35 is lower than that of metal forming the base material 34. The sacrificial layer 35 and the base material 34 are diffusion bonded. That is, the heat transfer tube 24*a* is formed of a clad material. The sacrificial layer 35 is formed over the entire length of the heat transfer tube 24*a*. The thickness to of the sacrificial layer 35 is substantially uniform throughout the circumference of the base material 34. With this arrangement, the thickness to is the maximum thickness of the sacrificial layer 35. In the present embodiment, the outer diameter Do1 of the heat transfer tube 24*a* is 5 mm to 7 mm, and a wall thickness To (=(Do1−Do2)/2) of the heat transfer tube 24*a* is 0.4 mm to 0.5 mm. The thickness to of the sacrificial layer 35 is preferably 0.04 mm or more. For example, thickness to of the sacrificial layer 35 is 0.05 mm.

Figure 4B:
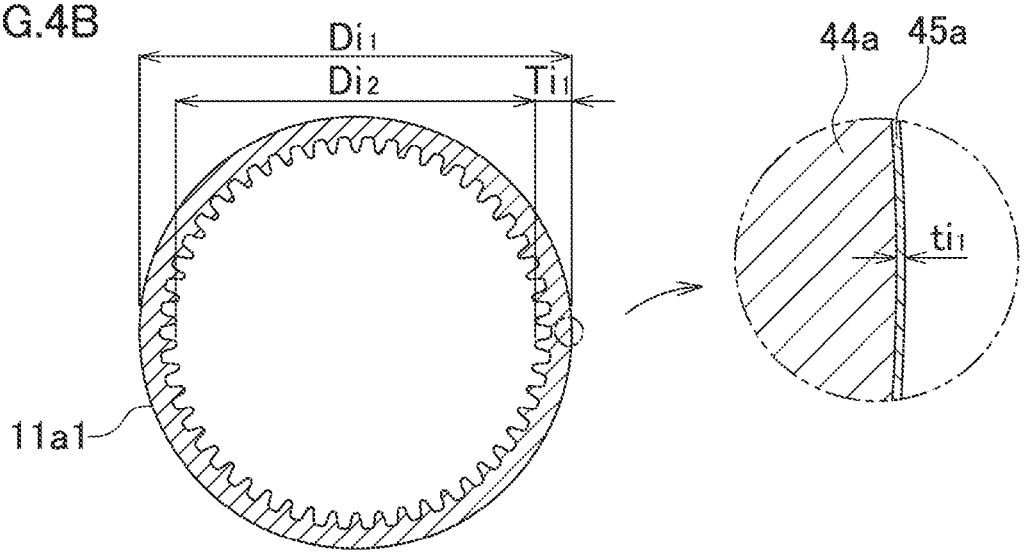
FIG. 4B is a cross section and partial enlarged view of a heat transfer tube (first heat transfer tube) of a first group of an indoor heat exchanger.

As shown in FIG. 4B, each heat transfer tube 11*a*1 of the first group of the indoor heat exchanger 11 is a cylindrical tube with an outer diameter Di1 and an inner diameter Di2. An inner circumferential surface of the heat transfer tube 11*a*1 is an uneven surface in the same manner as shown in an example of FIG. 4A. As shown in the partial enlarged view, the heat transfer tube 11*a*1 is formed of: the base material 44*a* made of aluminum or aluminum alloy; and the sacrificial layer 45*a* which is made of zinc or alloy including zinc and which is formed on the outer circumferential surface of the base material 44*a*. The electric potential of metal forming the sacrificial layer 45*a* is lower than that of metal forming the base material 44*a*. The sacrificial layer 45*a* and the base material 44*a* are diffusion bonded. That is, the heat transfer tube 11*a*1 is formed of a clad material. The sacrificial layer 45*a* is formed over the entire length of the heat transfer tube 11*a*1. The thickness ti1 of the sacrificial layer 45*a* is substantially uniform throughout the circumference of the base material 44*a*. With this arrangement, the thickness ti1 is the maximum thickness of the sacrificial layer 45*a*. In the present embodiment, the outer diameter Di1 of the heat transfer tube 11*a*1 is 5 mm to 7 mm, and the wall thickness Ti1 (=(Di1−Di2)/2) of the heat transfer tube 11*a*1 is 0.3 mm to 0.4 mm. The thickness ti1 of the sacrificial layer 45*a* is preferably 0.01 mm or more. For example, thickness ti1 of the sacrificial layer 45*a* is 0.03 mm.

Figure 4C:
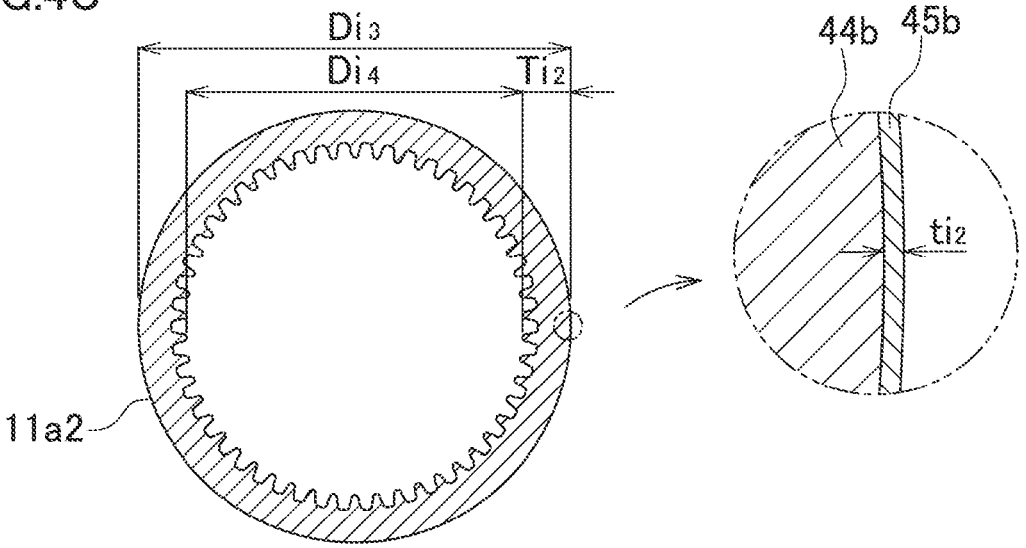
FIG. 4C is a cross section and partial enlarged view of a heat transfer tube (third heat transfer tube) of a second group of the indoor heat exchanger.

As shown in FIG. 4C, each heat transfer tube 11*a*2 of the second group of the indoor heat exchanger 11 is a cylindrical tube with an outer diameter Di3 and an inner diameter Di4. An inner circumferential surface of the heat transfer tube 11*a*2 is an uneven surface in the same manner as shown in the example of FIG. 4A. As shown in the partial enlarged view, the heat transfer tube 11*a*2 is formed of: the base material 44*b* made of aluminum or aluminum alloy; and the sacrificial layer 45*b* which is made of zinc or alloy including zinc and which is formed on the outer circumferential surface of the base material 44*b*. The electric potential of metal forming the sacrificial layer 45*b* is lower than that of metal forming the base material 44*b*. The sacrificial layer 45*b* and the base material 44*b* are diffusion bonded. That is, the heat transfer tube 11*a*2 is formed of a clad material. The sacrificial layer 45*b* is formed over the entire length of the heat transfer tube 11*a*2. The thickness ti2 of the sacrificial layer 45*b* is substantially uniform throughout the circumference of the base material 44*b*. With this arrangement, the thickness ti2 is the maximum thickness of the sacrificial layer 45*b*. In the present embodiment, the outer diameter Di3 of the heat transfer tube 11*a*2 is 5 mm to 7 mm, and the wall thickness Ti2 (=(Di3−Di4)/2) of the heat transfer tube 11*a*2 is 0.4 mm to 0.5 mm. The thickness ti2 of the sacrificial layer 45*b* is preferably 0.02 mm or more. For example, thickness ti2 of the sacrificial layer 45*b* is 0.04 mm.

In the present embodiment, the thickness to of the sacrificial layer 35 of the outdoor heat exchanger 24 is larger than the thickness ti2 of the sacrificial layer 45*b* of the second group of the indoor heat exchanger 11, and the thickness ti2 of the sacrificial layer 45*b* is larger than the thickness ti1 of the sacrificial layer 45*a* of the first group of the indoor heat exchanger 11. That is, the sacrificial layer 35, the sacrificial layer 45*b*, and the sacrificial layer 45*a* in this order are the largest, the second largest, and the third largest in maximum thickness (to>ti2>ti1). The thickness of each of the sacrificial layers 35, 45*a*, and 45*b* can be measured with use of an electron probe micro analyzer (EPMA), etc. To check the thickness of each of the sacrificial layers 35, 45*a*, and 45*b*, each of the heat transfer tubes 24*a*, 11*a*1, and 11*a*2 is cut not at around its end portion to which the U-bend 24*b* or 11*b* is brazed but at around its center in the longitudinal direction.

In the present embodiment, the outer diameter Do1 and inner diameter Do2 of the heat transfer tube 24*a* of the outdoor heat exchanger 24 are the same as the outer diameter Di3 and inner diameter Di4 of the heat transfer tube 11*a*2 of the second group of the indoor heat exchanger 11 (Do1=Di3, Do2=Di4). With this arrangement, the wall thickness To of the heat transfer tube 24*a* is the same as the wall thickness Ti2 of the heat transfer tube 11*a*2 (To=Ti2). The outer diameter Do1 of the heat transfer tube 24*a*, the outer diameter Di1 of the heat transfer tube 11*a*1, and the outer diameter Di3 of the heat transfer tube 11*a*2 are the same as one another (Do1=Di1=Di3). Meanwhile, the inner diameter Di2 of the heat transfer tube 11*a*1 is larger than each of the inner diameter Do2 of the heat transfer tube 24*a* of the outdoor heat exchanger 24 and the inner diameter Di4 of the heat transfer tube 11*a*2 (Do2, Di4<Di2). With this arrangement, the wall thickness Ti1 of the heat transfer tube 11*a*1 is smaller than each of the wall thickness To of the heat transfer tube 24*a* of the outdoor heat exchanger 24 and the wall thickness Ti2 of the heat transfer tube 11*a*2 (Ti1<To, Ti2).

Figure 5A:
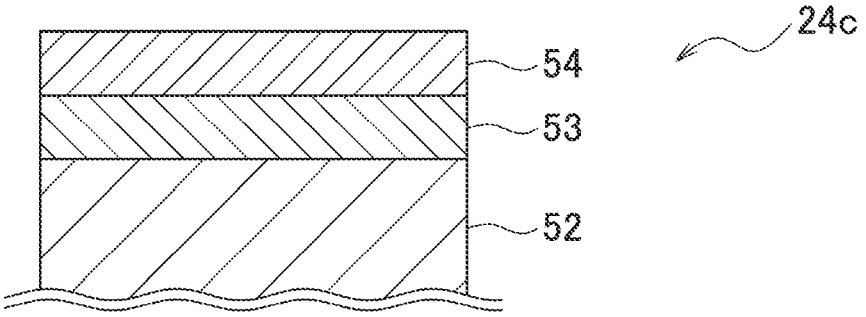
FIG. 5A is a partially enlarged cross section of a surface of a fin of the outdoor heat exchanger and its surroundings.

The following will describe the structure of each fin 24*c* of the outdoor heat exchanger with reference to FIG. 5A. The fin 24*c* is formed of a base material 52 which is made of aluminum or aluminum alloy and on a surface of which coatings are formed. As shown in FIG. 5A, a hydrophobic coating 53 and a hydrophilic coating 54 which are made of urethane resin are formed in this order on the base material 52. These coatings are formed by a dipping process. Both the hydrophobic coating 53 and the hydrophilic coating 54 improve the corrosion resistance of the fin 24*c*. The hydrophilic coating 54 facilitates the drainage of a drain adhering to the fin 24*c*.

Figure 5B:
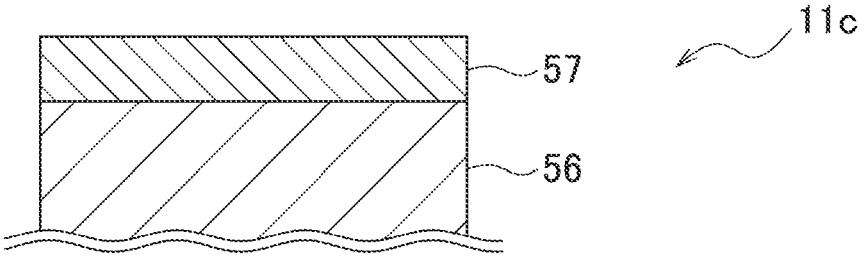
FIG. 5B is a partially enlarged cross section of a surface of a fin of the indoor heat exchanger and its surroundings.

The following will describe the structure of each fin 11*c* of the indoor heat exchanger with reference to FIG. 5B. The fin 11*c* is formed of a base material 56 which is made of aluminum or aluminum alloy and on a surface of which a coating is formed. As shown in FIG. 5B, a hydrophilic coating 57 is formed on the base material 56. The hydrophilic coating 57 is formed by the dipping process. The hydrophilic coating 57 improves the corrosion resistance of the fin 11*c*, and facilitates the drainage of a drain adhering to the fin 11*c*. In the present embodiment, the thickness of a combination of the hydrophobic coating 53 and hydrophilic coating 54 of the fin 24*c* is larger than that of the hydrophilic coating 57 of the fin 11*c*.

The following will describe the progress of corrosion in the heat transfer tubes 11*a* and 24*a*. In an initial state (immediately after manufacture), the entire circumferences of the base materials 34, 44*a*, and 44*b* are respectively covered by the sacrificial layers 35, 45*a*, and 45*b*. With this arrangement, the corrosion begins not at the base materials 34, 44*a*, and 44*b* but at the sacrificial layers 35, 45*a*, and 45*b*. When electric potential on each of the surfaces of the sacrificial layers 35, 45*a*, and 45*b* is ideally constant, the corrosion progresses so that the thickness of each of the sacrificial layers 35, 45*a*, and 45*b* decreases uniformly throughout each of the sacrificial layers 35, 45*a*, and 45*b*. Because of this, when the outer circumferential surfaces of the base materials 34, 44*a*, and 44*b* are exposed, the sacrificial layers 35, 45*a*, and 45*b* no longer exist. Meanwhile, when electric potential is not constant on each of the surfaces of the sacrificial layers 35, 45*a*, and 45*b*, each of the sacrificial layers 35, 45*a*, and 45*b* is rapidly corroded at its part where electric potential is low. As a result, the outer circumferential surfaces of the base materials 34, 44*a*, and 44*b* are partially exposed while the sacrificial layers 35, 45*a*, and 45*b* partially remain. In this regard, the electric potential of zinc or alloy including zinc forming the sacrificial layers 35, 45*a*, and 45*b* is lower than that of aluminum or aluminum alloy forming the base materials 34, 44*a*, and 44*b*. Because of this, the corrosion of the base materials 34, 44*a*, and 44*b* does not begin yet, and the corrosion of the sacrificial layers 35, 45*a*, and 45*b* further progresses so that the sacrificial layers 35, 45*a*, and 45*b* on the base materials 34, 44*a*, and 44*b* no longer exist. At this point, pitting corrosion of the base materials 34, 44*a*, and 44*b* begins in each of the following cases: the case where electric potential is constant on each of the surfaces of the sacrificial layers 35, 45*a*, and 45*b*; and the case where electric potential is not constant on each of the surfaces of the sacrificial layers 35, 45*a*, and 45*b*. The pitting corrosion is a phenomenon in which the corrosion progresses typically in a thickness direction of a material.

The progress of the corrosion is described above. Therefore, when (i) the thickness of each of the base materials 34, 44*a*, and 44*b* is large and (ii) the thickness of each of the sacrificial layers 35, 45*a*, and 45*b* is small, the sacrificial layers 35, 45*a*, and 45*b* disappear in a relatively short period of time from the initial state and, thereafter, a through hole is formed on each of the heat transfer tubes 11*a* and 24*a* because of the pitting corrosion in a relatively short period of time. Meanwhile, when the thickness of each of the sacrificial layers 35, 45*a*, and 45*b* is large, a relatively long period of time is required for the sacrificial layers 35, 45*a*, and 45*b* on the base materials 34, 44*a*, and 44*b* to disappear. After that, even if a through hole is formed on each of the heat transfer tubes 11*a* and 24*a* because of the pitting corrosion in a relatively short period of time, a period of time from the initial state to a state in which a through hole is formed in each of the heat transfer tubes 11*a* and 24*a* is long. In the present embodiment, the thickness to of the sacrificial layer 35 formed on the outer circumferential surface of the heat transfer tube 24*a* of the outdoor heat exchanger 24 is larger than the thickness ti1 of the sacrificial layer 45*a* formed on the outer circumferential surface of the heat transfer tube 11*a*1 of the indoor heat exchanger 11. With this arrangement, the corrosion is suppressed at the following tubes: the heat transfer tube 11*a*1 of the indoor heat exchanger 11 in which a refrigerant exchanging heat with the room air flows; and the heat transfer tube 24*a* of the outdoor heat exchanger 24 in which a refrigerant exchanging heat with the outdoor air flows. The salt content of the room air is low, and the salt content of the outdoor air is high. Furthermore, because the sacrificial layer 45*a* does not need to be thick, an amount of use of materials is reduced. As a result, low cost is achieved.

The thickness ti2 of the sacrificial layer 45*b* formed on the outer circumferential surface of the heat transfer tube 11*a*2 of the second group of the indoor heat exchanger 11 is larger than the thickness ti1 of the sacrificial layer 45*a* formed on the outer circumferential surface of the heat transfer tube 11*a*1 of the first group of the indoor heat exchanger 11. With this arrangement, the corrosion is suppressed at the following tubes: the heat transfer tube 11*a*1 of the indoor heat exchanger 11 in which a refrigerant exchanging heat with the room air flows; and the heat transfer tube 11*a*2 of the indoor heat exchanger 11 in which a refrigerant exchanging heat with the heated air or humid air flows. In this regard, the salt content of the room air is low, and the salt content of each of the heated air and the humid air is lower than that of the outdoor air and higher than that of the room air. Furthermore, because the sacrificial layer 45*a* does not need to be thick, an amount of use of materials is reduced. As a result, the low cost is achieved. In addition to that, because the thickness ti2 of the sacrificial layer 45*b* is smaller than the thickness to of the sacrificial layer 35, an amount of use of materials is reduced. As a result, the low cost is achieved.

The thickness ti1 of the sacrificial layer 45*a* of the indoor heat exchanger 11 is relatively small so that the ratio of thickness of the base material 44*a* to that of the sacrificial layer 45*a* is large in the heat transfer tube 11*a*1. This makes it easy to maintain the outer diameter Di1 of the heat transfer tube 11*a*1 and to suppress the decrease of the inner diameter Di2 of the heat transfer tube 11*a*1. By suppressing the decrease of the inner diameter Di2 of the heat transfer tube 1*a*1, (i) the increase in pressure drop of a refrigerant passing through the heat transfer tube 11*a*1 of the indoor heat exchanger 11 and (ii) the decrease in capacity of the indoor heat exchanger 11 are suppressed. To put it differently, the thickness ti1 of the sacrificial layer 45*a* of the indoor heat exchanger 11 is relatively small so that the ratio of thickness of the base material 44*a* to that of the sacrificial layer 45*a* is large in the heat transfer tube 11*a*1. This makes it possible to maintain the inner diameter Di2 of the heat transfer tube

11*a*1 and to suppress the increase of the outer diameter Di1 of the heat transfer tube 11*a*1. By suppressing the increase of the outer diameter Di1 of the heat transfer tube 11*a*1, (i) the structure of the fin 11*c* does not need to be greatly changed and (ii) air resistance is not increased in the indoor heat exchanger 11.

In the present embodiment, the thickness ti1 of the sacrificial layer 45*a* is smaller than each of the thickness to of the sacrificial layer 35 and the thickness ti2 of the sacrificial layer 45*b* as described above. With this arrangement, the necessary thickness of the base material 44*a* is secured, and the wall thickness Ti1 of the heat transfer tube 11*a*1 which is a combination of the sacrificial layer 45*a* and the base material 44*a* is smaller than each of the wall thickness To of the heat transfer tube 24*a* and the wall thickness Ti2 of the heat transfer tube 11*a*2. This improves the efficiency of heat conduction in the heat transfer tube 11*a*1 of the indoor heat exchanger 11.

In the present embodiment, the inner diameter Di2 of the heat transfer tube 11*a*1 of the first group of the indoor heat exchanger 11 is larger the inner diameter Do2 of the heat transfer tube 24*a* of the outdoor heat exchanger 24. This reduces the pressure drop of a refrigerant in the indoor heat exchanger 11. Furthermore, this makes the surface area of the inner circumferential surface of the heat transfer tube 11*a*1 relatively large. It is therefore possible to suppress the decrease in capacity of the indoor heat exchanger 11. In the present embodiment, the inner diameter Di2 of the heat transfer tube 11*a*1 of the first group of the indoor heat exchanger 11 is larger than the inner diameter Di4 of the heat transfer tube 11*a*2 of the second group of the indoor heat exchanger 11. This reduces the pressure drop of a refrigerant in the heat transfer tube 11*a*1 of the first group of the indoor heat exchanger 11. Furthermore, this makes the surface area of the inner circumferential surface of the heat transfer tube 11*a*1 relatively large. It is therefore possible to suppress the decrease in capacity of the heat transfer tube 11*a*1 of the first group of the indoor heat exchanger 11.

In the present embodiment, these sacrificial layers 35, 45*b*, and 45*a* in this order are the largest, the second largest, and the third largest in thickness (to>ti2>ti1). This order reflects the salt content of air passing through the surface of each sacrificial layer. That is, because the outdoor air whose salt content is high passes through the surface of the sacrificial layer 35, the sacrificial layer 35 is thickest. Furthermore, because the outdoor air whose salt content is low passes through the surface of the sacrificial layer 45*a*, the sacrificial layer 45*a* is thinnest. In addition to that, because the heated air or humid air which is lower in salt content than the outdoor air and higher in salt content than the room air passes through the surface of the sacrificial layer 45*b*, the sacrificial layer 45*b* is thinner than the sacrificial layer 35 and thicker than the sacrificial layer 45*a*. The thicknesses of the sacrificial layers 35, 45*a*, and 45*b* of three types are adjusted as described above. This suppresses the occurrence of a large difference between the heat transfer tubes 11*a*1, 11*a*2, and 24*a* of three types in terms of a period of time from the initial state to a state in which a through hole is formed.

The outer diameter Do1 of the heat transfer tube 24*a*, the outer diameter Di1 of the heat transfer tube 11*a*1, and the outer diameter Di3 of the heat transfer tube 11*a*2 are the same as one another (Do1=Di1=Di3). With this arrangement, the fins 11*c* and 24*c* are easily manufactured.

In the present embodiment, each of the sacrificial layers 35, 45*a*, and 45*b* is made of zinc or alloy including zinc, and each of the base materials is made of aluminum or aluminum alloy. In this regard, the electric potential of each of zinc and alloy including zinc is lower than that of each of aluminum and aluminum alloy. With this arrangement, a good sacrifice anti-corrosion effect is obtained. Each sacrificial layer may be made of metal which is neither zinc nor alloy including zinc, as long as the electric potential of the metal is lower than that of each of aluminum and aluminum alloy making a base material.

In the present embodiment, the heat transfer tube 24*a* of the outdoor heat exchanger 24 and the heat transfer tube 11*a* of the indoor heat exchanger 11 are formed of clad materials in which the base materials 34, 44*a*, and 44*b* and the sacrificial layers 35, 45*a*, and 45*b* are diffusion bonded. This suppresses the thickness variation of each of the sacrificial layers 35, 45*a*, and 45*b*. When the thickness variation of each sacrificial layer is significantly large, an exposed part of the outer circumferential surface of each of the base materials 34, 44*a*, and 44*b* may be so far from the remaining part of each of the sacrificial layers 35, 45*a*, and 45*b* that the exposed part of the outer circumferential surface of each of the base materials 34, 44*a*, and 44*b* has a position where the anti-corrosion effect is not expected. By using the clad materials, occurrence of this problem is suppressed.

In the present embodiment, coatings are formed on the fin 24*c* of the outdoor heat exchanger 24 and the fin 11*c* of the outdoor heat exchanger 11. With this arrangement, the fin 24*c* has the corrosion resistance. The thickness of a combination of the hydrophobic coating 53 and hydrophilic coating 54 of the fin 24*c* is larger than that of the hydrophilic coating 57 of the fin 11*c*. This improves the corrosion resistance of the fin 24*c* with which the outdoor air makes contact. In this regard, this improvement does not depend on the number of coatings formed on the fin 24*c* and the fin 11*c*. The number of coatings formed on the fin 24*c* may be smaller than or the same as that of coatings formed on the fin 11*c*.

Second Embodiment

Figure 6A:
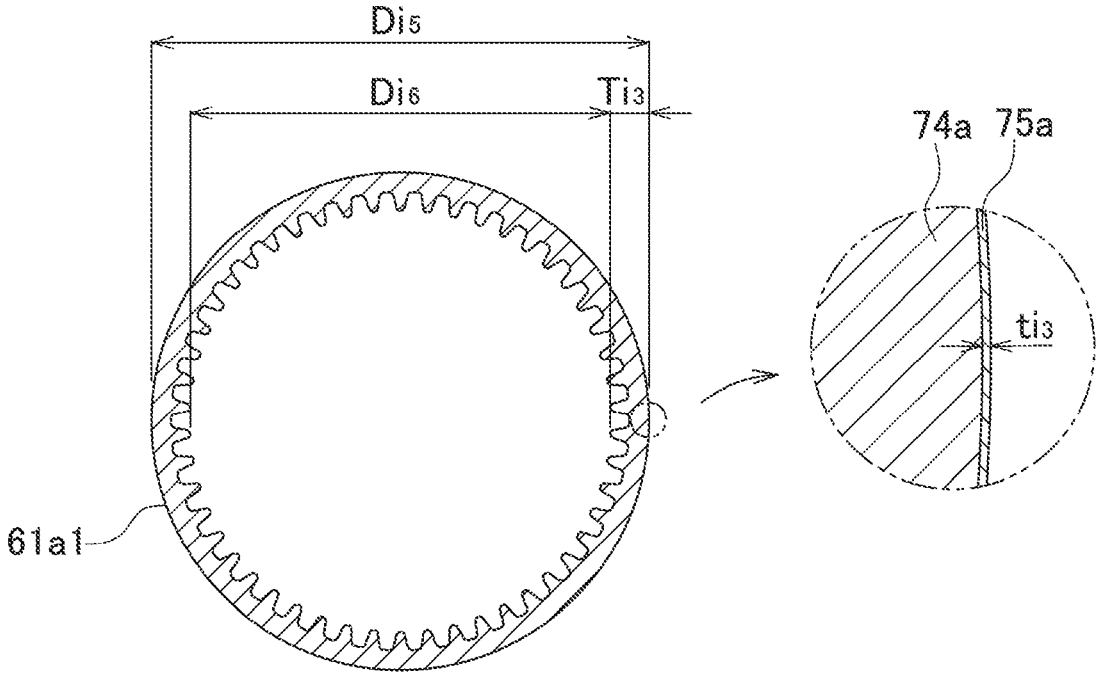
FIG. 6A is a cross section and partial enlarged view of a heat transfer tube (first heat transfer tube) of a first group of an indoor heat exchanger in an air conditioner of Second Embodiment of the present disclosure.
Figure 6B:
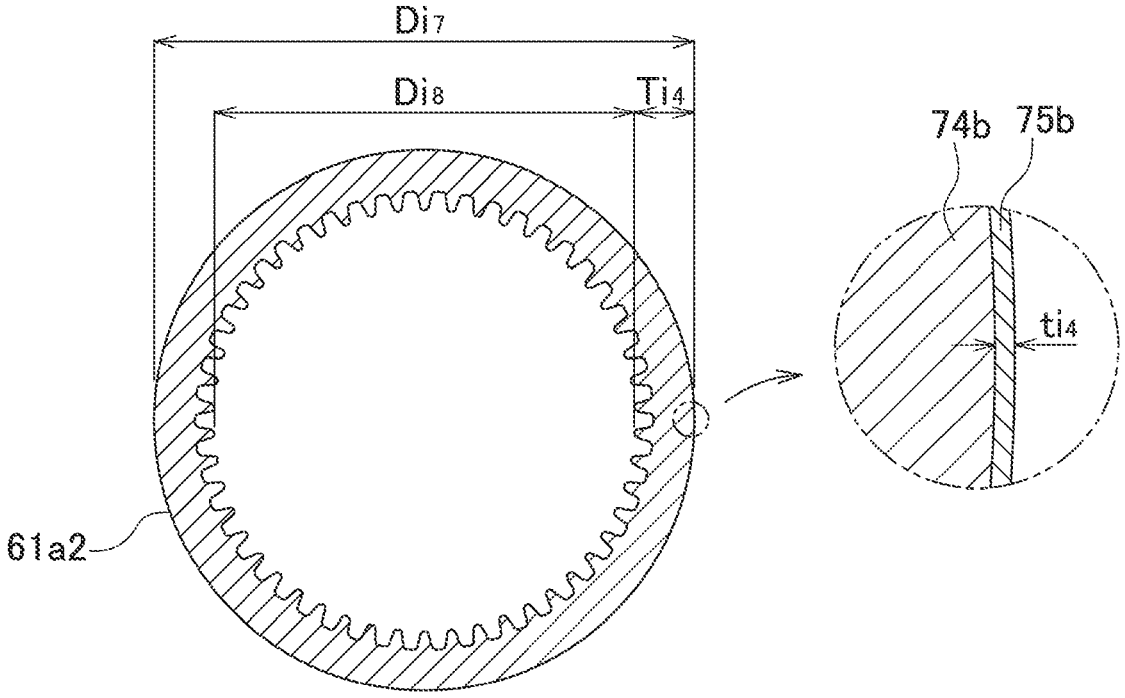
FIG. 6B is a cross section and partial enlarged view of a heat transfer tube (third heat transfer tube) of a second group of the indoor heat exchanger in the air conditioner of Second Embodiment of the present disclosure.

The following will describe Second Embodiment with reference to FIG. 6A and FIG. 6B. In an air conditioner of the present embodiment, the structure of each heat transfer tube of an outdoor heat exchanger 24 is the same as that in First Embodiment. However, the structure of each heat transfer tube of an indoor heat exchanger is different from that in First Embodiment. The following will mainly describe how the structure of each heat transfer tube of the indoor heat exchanger is different from that in First Embodiment. The structure of an air supply duct 8 is the same as that in First Embodiment, and heat transfer tubes of the indoor heat exchanger are divided into two groups, i.e., (i) heat transfer tubes (those will be denoted by a reference symbol 61*a*1 in the present embodiment) of a first group and (ii) heat transfer tubes (those will be denoted by a reference symbol 61*a*2 in the present embodiment) of a second group which are closer to an opening 8*a* of the air supply duct 8 than the heat transfer tubes 61*a*1 of the first group are to the opening 8*a*. To be more specific, the first group includes heat transfer tubes included in a front-surface intermediate part Bb, a front-surface lower part Bc, and a back-surface part Bd as shown in FIG. 3. The second group includes heat transfer tubes included in a front-surface upper part Ba. As described below, the thickness of a sacrificial layer formed on an outer circumferential surface of each heat transfer tube 61*a*2 of the second group is larger than that of a sacrificial layer formed on an outer circumferential surface of each heat transfer tube 61*a*1 of the first group.

As shown in FIG. 6A, each heat transfer tube 61*a*1 of the first group of the indoor heat exchanger is a cylindrical tube with an outer diameter Di5 and an inner diameter Di6. The heat transfer tube 61*a*1 is formed of: a base material 74*a* made of aluminum or aluminum alloy; and a sacrificial layer 75*a* which is made of zinc or alloy including zinc and which is formed on an outer circumferential surface of the base material 74*a*. The heat transfer tube 61*a*1 is formed of a clad material. The thickness ti3 of the sacrificial layer 75*a* is substantially uniform throughout the circumference of the base material 74*a*. With this arrangement, the thickness ti3 is the maximum thickness of the sacrificial layer 75*a*. In the present embodiment, the outer diameter Di5 of the heat transfer tube 61*a*1 is 4 mm to 6 mm, and the wall thickness Ti3 (=(Di5−Di6)/2) of the heat transfer tube 61*a*1 is 0.3 mm to 0.4 mm. The thickness ti3 of the sacrificial layer 75*a* is preferably 0.01 mm or more. For example, thickness ti3 of the sacrificial layer 75*a* is 0.03 mm.

As shown in FIG. 6B, each heat transfer tube 61*a*2 of the second group of the indoor heat exchanger is a cylindrical tube with an outer diameter Di7 and an inner diameter Di8. The heat transfer tube 61*a*2 is formed of: a base material 74*b* made of aluminum or aluminum alloy; and a sacrificial layer 75*b* which is made of zinc or alloy including zinc and which is formed on an outer circumferential surface of the base material 74*b*. The heat transfer tube 61*a*2 is formed of a clad material. The thickness ti4 of the sacrificial layer 75*b* is substantially uniform throughout the circumference of the base material 74*b*. With this arrangement, the thickness ti4 is the maximum thickness of the sacrificial layer 75*b*. In the present embodiment, the outer diameter Di7 of the heat transfer tube 61*a*2 is 5 mm to 7 mm, and the wall thickness Ti4 (=(Di7−Di8)/2) of the heat transfer tube 61*a*2 is 0.4 mm to 0.5 mm. The thickness ti4 of the sacrificial layer 75*b* is preferably 0.02 mm or more. For example, thickness ti4 of the sacrificial layer 75*b* is 0.04 mm.

In the present embodiment, a sacrificial layer 35, the sacrificial layer 75*b*, and the sacrificial layer 75*a* in this order are the largest, the second largest, and the third largest in maximum thickness (to>ti4>ti3).

In the present embodiment, an outer diameter Do1 and inner diameter Do2 of each heat transfer tube 24*a* of the outdoor heat exchanger 24 are the same as the outer diameter Di7 and inner diameter Di8 of the heat transfer tube 61*a*2 of the second group of the indoor heat exchanger (Do1=Di7, Do2=Di8). With this arrangement, the wall thickness To of the heat transfer tube 24*a* is the same as the wall thickness Ti4 of the heat transfer tube 61*a*2 (To=Ti4). The inner diameter Do2 of the heat transfer tube 24*a*, the inner diameter Di6 of the heat transfer tube 61*a*1, and the inner diameter Di8 of the heat transfer tube 61*a*2 are the same as one another (Do2=Di6=Di8). Meanwhile, the outer diameter Di5 of the heat transfer tube 61*a*1 is smaller than each of the outer diameter Do1 of the heat transfer tube 24*a* and the outer diameter Di7 of the heat transfer tube 61*a*2 (Di5<Do1, Di7). With this arrangement, the wall thickness Ti3 of the heat transfer tube 61*a*1 is smaller than each of the wall thickness To of the heat transfer tube 24*a* of the outdoor heat exchanger 24 and the wall thickness Ti4 of the heat transfer tube 61*a*2 (Ti3<To, Ti4).

In the present embodiment, the thickness to of the sacrificial layer 35 formed on an outer circumferential surface of the heat transfer tube 24*a* of the outdoor heat exchanger 24 is larger than the thickness ti3 of the sacrificial layer 75*a* formed on the outer circumferential surface of the heat transfer tube 61*a*1 of the indoor heat exchanger. With this arrangement, corrosion is suppressed at the following tubes: the heat transfer tube 61*a*1 of the indoor heat exchanger in which a refrigerant exchanging heat with room air flows; and the heat transfer tube 24*a* of the outdoor heat exchanger 24 in which a refrigerant exchanging heat with outdoor air flows. The salt content of the room air is low, and the salt content of the outdoor air is high. Furthermore, because the sacrificial layer 75*a* does not need to be thick, an amount of use of materials is reduced. As a result, low cost is achieved. The thickness ti4 of the sacrificial layer 75*b* is larger than the thickness ti3 of the sacrificial layer 75*a*. With this arrangement, the corrosion is suppressed at the heat transfer tubes 61*a*1 and 61*a*2.

In the present embodiment, the thickness ti3 of the sacrificial layer 75*a* is smaller than each of the thickness to of the sacrificial layer 35 and the thickness ti4 of the sacrificial layer 75*b* as described above. With this arrangement, the necessary thickness of the base material 74*a* is secured, and the wall thickness Ti3 of the heat transfer tube 61*a*1 which is a combination of the sacrificial layer 75*a* and the base material 74*a* is smaller than each of the wall thickness To of the heat transfer tube 24*a* and the wall thickness Ti4 of the heat transfer tube 61*a*2. This improves the efficiency of heat conduction in the heat transfer tube 61*a*1 of the indoor heat exchanger.

In the present embodiment, the outer diameter Di5 of the heat transfer tube 61*a*1 of the first group is smaller than each of the outer diameter Do1 of the heat transfer tube 24*a* of the outdoor heat exchanger 24 and the outer diameter Di7 of the heat transfer tube 61*a*2 of the second group. This suppresses the increase in resistance of air passing through the indoor heat exchanger.

Third Embodiment

Figure 7A:
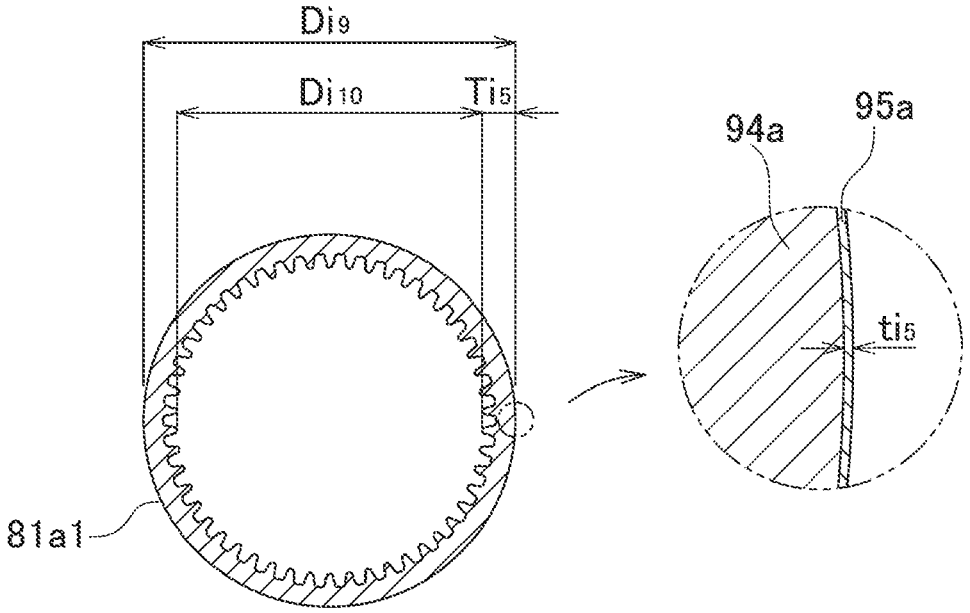
FIG. 7A is a cross section and partial enlarged view of a heat transfer tube (first heat transfer tube) of a first group of an indoor heat exchanger in an air conditioner of Third Embodiment of the present disclosure.
Figure 7B:
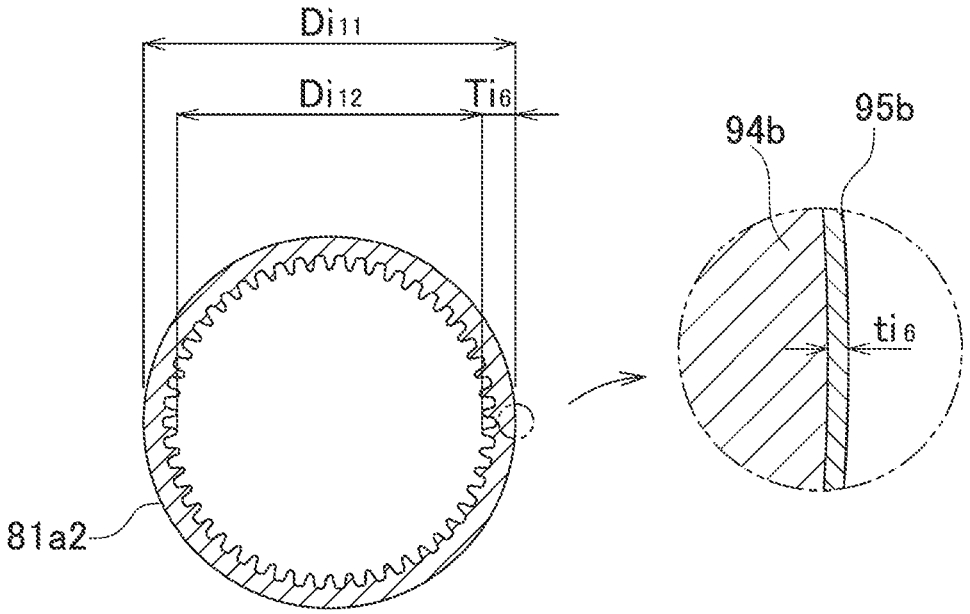
FIG. 7B is a cross section and partial enlarged view of a heat transfer tube (third heat transfer tube) of a second group of the indoor heat exchanger in the air conditioner of Third Embodiment of the present disclosure.

The following will describe Third Embodiment with reference to FIG. 7A and FIG. 7B. In an air conditioner of the present embodiment, the structure of each heat transfer tube of an outdoor heat exchanger 24 is the same as that in First Embodiment. However, the structure of each heat transfer tube of an indoor heat exchanger is different from that in First Embodiment. The following will mainly describe how the structure of each heat transfer tube of the indoor heat exchanger is different from that in First Embodiment. The structure of an air supply duct 8 is the same as that in First Embodiment, and heat transfer tubes of the indoor heat exchanger are divided into two groups, i.e., (i) heat transfer tubes (those will be denoted by a reference symbol 81*a*1 in the present embodiment) of a first group and (ii) heat transfer tubes (those will be denoted by a reference symbol 81*a*2 in the present embodiment) of a second group which are closer to an opening 8*a* of the air supply duct 8 than the heat transfer tubes 81*a*1 of the first group are to the opening 8*a*. To be more specific, the first group includes heat transfer tubes included in a front-surface intermediate part Bb, a front-surface lower part Bc, and a back-surface part Bd as shown in FIG. 3. The second group includes heat transfer tubes included in a front-surface upper part Ba. As described below, the thickness of a sacrificial layer formed on an outer circumferential surface of each heat transfer tube 81*a*2 of the second group is larger than that of a sacrificial layer formed on an outer circumferential surface of each heat transfer tube 81*a*1 of the first group.

As shown in FIG. 7A, each heat transfer tube 81*a*1 of the first group of the indoor heat exchanger is a cylindrical tube with an outer diameter Di9 and an inner diameter Di10. The heat transfer tube 81*a*1 is formed of: a base material 94*a* made of aluminum or aluminum alloy; and a sacrificial layer

95*a* which is made of zinc or alloy including zinc and which is formed on an outer circumferential surface of the base material 94*a*. The heat transfer tube 81*a*1 is formed of a clad material. The thickness ti5 of the sacrificial layer 95*a* is substantially uniform throughout the circumference of the base material 94*a*. With this arrangement, the thickness ti5 is the maximum thickness of the sacrificial layer 95*a*. In the present embodiment, the outer diameter Di9 of the heat transfer tube 81*a*1 is 3 mm to 5 mm, and the wall thickness Ti5 (=(Di9−Di10)/2) of the heat transfer tube 81*a*1 is 0.3 mm to 0.4 mm. The thickness ti5 of the sacrificial layer 95*a* is preferably 0.01 mm or more. For example, thickness ti5 of the sacrificial layer 95*a* is 0.03 mm.

As shown in FIG. 7B, each heat transfer tube 81*a*2 of the second group of the indoor heat exchanger is a cylindrical tube with an outer diameter Di11 and an inner diameter Di12. The heat transfer tube 81*a*2 is formed of: a base material 94*b* made of aluminum or aluminum alloy; and a sacrificial layer 95*b* which is made of zinc or alloy including zinc and which is formed on an outer circumferential surface of the base material 94*b*. The heat transfer tube 81*a*2 is formed of a clad material. The thickness ti6 of the sacrificial layer 95*b* is substantially uniform throughout the circumference of the base material 94*b*. With this arrangement, the thickness ti6 is the maximum thickness of the sacrificial layer 95*b*. In the present embodiment, the outer diameter Di11 of the heat transfer tube 81*a*2 is 3 mm to 5 mm, and the wall thickness Ti6 (=(Di11−Di12)/2) of the heat transfer tube 81*a*2 is 0.3 mm to 0.4 mm. The thickness ti6 of the sacrificial layer 95*b* is preferably 0.02 mm or more. For example, thickness ti6 of the sacrificial layer 95*b* is 0.04 mm.

In the present embodiment, a sacrificial layer 35, the sacrificial layer 95*b*, and the sacrificial layer 95*a* in this order are the largest, the second largest, and the third largest in maximum thickness (to>ti6>ti5).

In the present embodiment, the outer diameter Di9 and inner diameter Di10 of the heat transfer tube 81*a*1 of the first group of the indoor heat exchanger are the same as the outer diameter Di11 and inner diameter Di12 of the heat transfer tube 81*a*2 of the second group of the indoor heat exchanger (Di9=Di11, Di10=Di12). Each of the outer diameter Di9 of the heat transfer tube 81*a*1 and the outer diameter Di11 of the heat transfer tube 81*a*2 is smaller than an outer diameter Do1 of each heat transfer tube 24*a* of the outdoor heat exchanger 24 (Di9, Di11<Do1). Each of the inner diameter Di10 of the heat transfer tube 81*a*1 and the inner diameter Di12 of the heat transfer tube 81*a*2 is smaller than an inner diameter Do2 of the heat transfer tube 24*a* of the outdoor heat exchanger 24 (Di10, Di12<Do2). Each of the wall thickness Ti5 of the heat transfer tube 81*a*1 and the wall thickness Ti6 of the heat transfer tube 81*a*2 is smaller than the wall thickness To of the heat transfer tube 24*a* (Ti5, Ti6<To).

In the present embodiment, the thickness to of the sacrificial layer 35 formed on an outer circumferential surface of the heat transfer tube 24*a* of the outdoor heat exchanger 24 is larger than the thickness ti5 of the sacrificial layer 95*a* formed on the outer circumferential surface of the heat transfer tube 81*a*1 of the indoor heat exchanger. With this arrangement, corrosion is suppressed at the following tubes: the heat transfer tube 81*a*1 of the indoor heat exchanger in which a refrigerant exchanging with room air flows; and the heat transfer tube 24*a* of the outdoor heat exchanger 24 in which a refrigerant exchanging heat with outdoor air flows. The salt content of the room air is low, and the salt content of the outdoor air is high. Furthermore, because the sacrificial layer 95*a* does not need to be thick, an amount of use of materials is reduced. As a result, low cost is achieved. The thickness ti6 of the sacrificial layer 95*b* is larger than the thickness ti5 of the sacrificial layer 95*a*. With this arrangement, the corrosion is suppressed at the heat transfer tubes 81*a*1 and 81*a*2.

In the present embodiment, each of the thickness ti5 of the sacrificial layer 95*a* and the thickness ti6 of the sacrificial layer 95*b* is smaller than the thickness to of the sacrificial layer 35 as described above. With this arrangement, the necessary thicknesses of the base materials 94*a* and 94*b* are secured, and each of the following wall thicknesses is smaller than the wall thickness To of the heat transfer tube 24*a*: the wall thickness Ti5 of the heat transfer tube 81*a*1 which is a combination of the sacrificial layer 95*a* and the base material 94*a*; and the wall thickness Ti6 of the heat transfer tube 81*a*2 which is a combination of the sacrificial layer 95*b* and the base material 94*b*. This improves the efficiency of heat conduction in the heat transfer tubes 81*a*1 and 81*a*2 of the indoor heat exchanger.

In the present embodiment, each of the outer diameter Di5 of the heat transfer tube 61*a*1 the first group and the outer diameter Di7 of the heat transfer tube 61*a*2 of the second group is smaller the outer diameter Do1 of the heat transfer tube 24*a* of the outdoor heat exchanger 24. This suppresses the increase in resistance of air passing through the indoor heat exchanger as compared to Second Embodiment.

Fourth Embodiment

Figure 8:
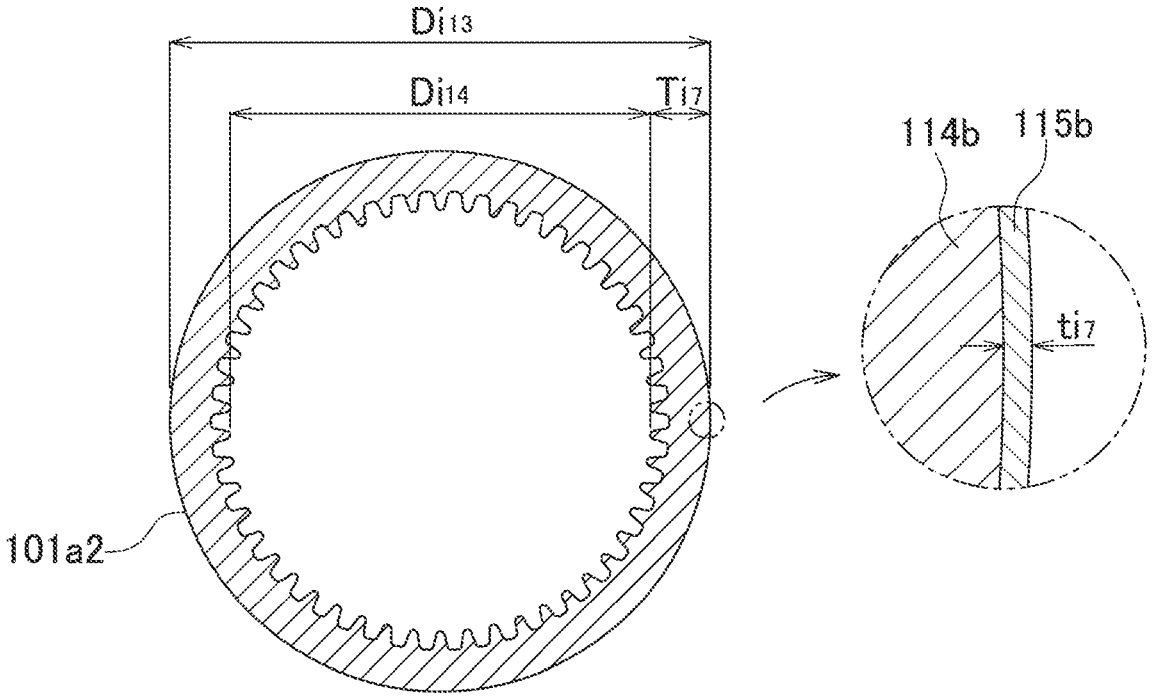
FIG. 8 is a cross section and partial enlarged view of a heat transfer tube (third heat transfer tube) of a second group of an indoor heat exchanger in an air conditioner of Fourth Embodiment of the present disclosure.

The following will describe Fourth Embodiment with reference to FIG. 8. An outdoor unit 3 of an air conditioner of the present embodiment does not include a humidification unit 5 shown in FIG. 2. An air supply duct 8 is configured to supply the inhaled outdoor air directly to an indoor unit 2. With this arrangement, the salt content of air blown out from an opening 8*a* of the air supply duct 8 is the same as that of the outdoor air. The air conditioner of the present embodiment is different from that of First Embodiment in terms of the thickness of a sacrificial layer formed on an outer circumferential surface of each heat transfer tube of a second group. The following will mainly describe this difference. In the present embodiment, the outdoor unit 3 may include a unit instead of the humidification unit 5 and this unit may take in the outdoor air and supply the outdoor air to the indoor unit 2 through the air supply duct 8 without reducing the salt content of the outdoor air.

In the present embodiment, each heat transfer tube of an outdoor heat exchanger is the same as that in First Embodiment shown in FIG. 4A. Each heat transfer tube of a first group of an indoor heat exchanger is the same as that in First Embodiment shown in FIG. 4B. As shown in FIG. 8, each heat transfer tube 101*a*2 of the second group of the indoor heat exchanger is a cylindrical tube with an outer diameter Di13 and an inner diameter Di14. The heat transfer tube 101*a*2 is formed of: a base material 114*b* made of aluminum or aluminum alloy; and a sacrificial layer 115*b* which is made of zinc or alloy including zinc and which is formed on an outer circumferential surface of the base material 114*b*. The heat transfer tube 101*a*2 is formed of a clad material. The thickness ti7 of the sacrificial layer 115*b* is substantially uniform throughout the circumference of the base material 114*b*. With this arrangement, the thickness ti7 is the maximum thickness of the sacrificial layer 115*b*. In the present embodiment, the outer diameter Di13 of the heat transfer tube 61*a*2 is 5 mm to 7 mm, and the wall thickness Ti7 (=(Di13−Di14)/2) of the heat transfer tube 61*a*2 is 0.4 mm to 0.5 mm. The thickness ti7 of the sacrificial layer 115*b* is preferably 0.04 mm or more. For example, thickness ti7 of the sacrificial layer 115*b* is 0.05 mm.

In the present embodiment, the thickness to of the sacrificial layer 35 of the outdoor heat exchanger 24 is the same as the thickness ti7 of the sacrificial layer 115*b* of the second group of the indoor heat exchanger. Each of these thicknesses to and ti7 is larger than the thickness ti1 of the sacrificial layer 45*a* of the first group of the indoor heat exchanger (to=ti7>ti1). In the present embodiment, because the salt content of air blown out from the opening 8*a* of the air supply duct 8 is the same as that of the outdoor air, the thickness ti7 of the sacrificial layer 115*b* of the second group is the same as the thickness to of the sacrificial layer 35 of the outdoor heat exchanger 24 as described above. With this arrangement, corrosion is suppressed at the heat transfer tube 101*a*2 of the second group to the same degree as at the heat transfer tube 24*a* of the outdoor heat exchanger 24.

Fifth Embodiment

Figure 9:
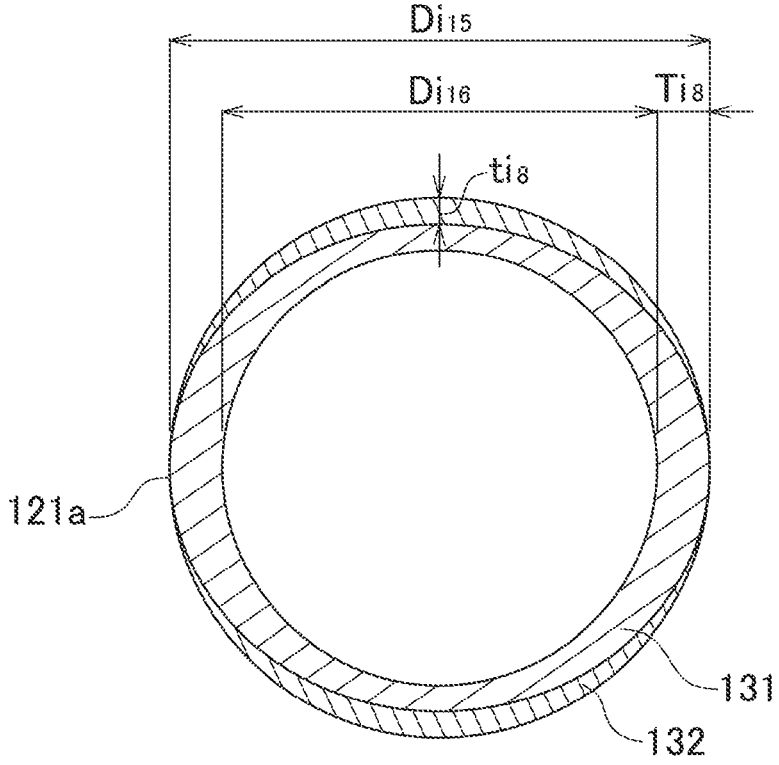
FIG. 9 is a schematic cross section of a heat transfer tube (first heat transfer tube) of an indoor heat exchanger in an air conditioner of Fifth Embodiment of the present disclosure.

The following will describe Fifth Embodiment with reference to FIG. 9. FIG. 9 is a schematic diagram which illustrates the thickness of each sacrificial layer with a size larger than an actual size. In an outdoor unit of an air conditioner of the present embodiment, the structure of each heat transfer tube of an outdoor heat exchanger 24 is the same as that in First Embodiment. However, the structure of each heat transfer tube of an indoor heat exchanger is different from that in First Embodiment. The following will mainly describe how the structure of each heat transfer tube of the indoor heat exchanger is different from that in First Embodiment. In the present embodiment, an air supply duct is not provided, and heat transfer tubes of the indoor heat exchanger are not divided into groups depending on the thickness of each sacrificial layer.

As shown in FIG. 9, each heat transfer tube 121*a* of the indoor heat exchanger of the present embodiment is a cylindrical tube with an outer diameter Di15 and an inner diameter Di16. An inner circumferential surface of the heat transfer tube 121*a* is not an uneven surface on which ribs extend along a longitudinal direction thereof. The cross section of this inner circumferential surface is circular in shape. The heat transfer tube 121*a* is formed of: a base material 131 made of aluminum or aluminum alloy; and a sacrificial layer 132 which is made of aluminum-zinc alloy and which is formed on an outer circumferential surface of the base material 131. In First to Fourth Embodiments described above, each heat transfer tube is formed of a clad material in which a base material and a sacrificial layer are diffusion bonded. In the present embodiment, the sacrificial layer 132 is a diffuse layer which is made of aluminum-zinc alloy by spraying zinc on the base material 131. In this regard, zinc is used as metal the electric potential of which is lower than that of aluminum.

Preferably, zinc is uniformly sprayed on a base material throughout the circumference of the base material so as to form a sacrificial layer the thickness of which is uniform. However, because of the limitation in the manufacture, the thickness of a sacrificial layer actually formed tends to vary in a circumferential direction of a base material. In the heat transfer tube 121*a* of the present embodiment, as shown in FIG. 9, the maximum thickness ti8 of the sacrificial layer 132 is provided at two points on the outer circumferential surface of the base material 131 which are 180 degrees away from each other. The thickness of the sacrificial layer 132 decreases away from these two points. In the heat transfer tube 121*a* in which the thickness of the sacrificial layer varies in the circumferential direction of the base material, the larger the maximum thickness of the sacrificial layer is, the further corrosion is suppressed. This is understood by the progress of corrosion described in First Embodiment. In the present embodiment, the outer diameter Di15 of the heat transfer tube 121*a* is 4 mm to 6 mm, and the wall thickness Ti8 (=(Di15−Di16)/2) of the heat transfer tube 121*a* is 0.3 mm to 0.4 mm. The thickness ti8 of the sacrificial layer 132 is preferably 0.12 mm or more. For example, thickness ti8 of the sacrificial layer 132 is 0.12 mm.

The maximum thickness ti8 of the sacrificial layer 132 formed on the outer circumferential surface of the heat transfer tube 121*a* of the indoor heat exchanger is smaller than the maximum thickness to of a sacrificial layer 35 formed on an outer circumferential surface of each heat transfer tube 24*a* of the outdoor heat exchanger 2. In this regard, the sacrificial layer formed on the outer circumferential surface of the heat transfer tube of the outdoor heat exchanger 2 may be formed by spraying. In this case, the maximum thickness of the sacrificial layer formed on the outer circumferential surface of the heat transfer tube of the outdoor heat exchanger is preferably 0.17 mm or more.

In the present embodiment, an outer diameter Do1 of the heat transfer tube 24*a* of the outdoor heat exchanger 24 is the same as the outer diameter Di15 of the heat transfer tube 121*a* of the indoor heat exchanger (Do1=Di15). Meanwhile, the inner diameter Di16 of the heat transfer tube 121*a* is larger than an inner diameter Do2 of the heat transfer tube 24*a* of the outdoor heat exchanger 24 (Do2<Di16). With this arrangement, the wall thickness Ti8 of the heat transfer tube 121*a* is smaller than the wall thickness To of the heat transfer tube 24*a* of the outdoor heat exchanger 24 (Ti8<To).

In the present embodiment, the sacrificial layer 132 is relatively easily formed by spraying zinc on the base material 131. Effects which are the same as those of the heat transfer tube 11*a*1 of First Embodiment described above are obtained.

<Modifications>

In each of First to Fourth Embodiments described above, the heat transfer tubes of the first group or second group belong to each of the four parts (the front-surface upper part Ba, the front-surface intermediate part Bb, the front-surface lower part Bc, and the back-surface part Bd) of the indoor heat exchanger 11. That is, heat transfer tubes of two types between which the thickness of a sacrificial layer is different are not included in the same part. In a modification, however, the heat transfer tubes of the two types between which the thickness of the sacrificial layer is different may be included in each of the four parts by using the heat transfer tubes of the second group as heat transfer tubes on one line which is closer to the opening 8*a* of the air supply duct 8 and using the heat transfer tubes of the first group as heat transfer tubes on the other line which is further from the opening 8*a* than the heat transfer tubes of the second group. In this regard, the thickness of the sacrificial layer of each heat transfer tube of the second group is large while that of the first group is small.

In each of Embodiments described above, the outer diameter and inner diameter of each heat transfer tube may be suitably changed. For example, in First Embodiment, the outer diameter and inner diameter of the heat transfer tube 24*a* (see FIG. 4A) of the outdoor heat exchanger 24 may be the same as those of each heat transfer tube (see FIG. 4B) of the first group, those of the heat transfer tube 61*a*1 (see FIG. 6A) of the first group of Second Embodiment, or those of the heat transfer tube 81*a*1 (see FIG. 7A) of the first group of Third Embodiment. In First Embodiment, the outer diameter and inner diameter of the heat transfer tube 11*a*2 (see FIG. 4C) of the second group may be the same as those of the heat transfer tube 11*a*1 (see FIG. 4B) of the first group. In Second Embodiment, the outer diameter and inner diameter of the heat transfer tube 61*a*2 (see FIG. 6B) of the second group may be the same as those of the heat transfer tube 61*a*1 (see FIG. 6A) of the first group or those of the heat transfer tube 11*a*1 (see FIG. 4B) of the first group of First Embodiment.

In First Embodiment, the inner diameter Di2 of the heat transfer tube 11*a*1 of the first group is larger than the inner diameter Do2 of the heat transfer tube 24*a* of the outdoor heat exchanger 24, and the outer diameter Di1 of the heat transfer tube 11*a*1 of the first group is the same as the outer diameter Do1 of the heat transfer tube 24*a* of the outdoor heat exchanger 24. In Second Embodiment, the outer diameter Di5 of the heat transfer tube 61*a*1 of the first group is smaller than the outer diameter Do1 of the heat transfer tube 24*a* of the outdoor heat exchanger 24, and the inner diameter Di6 of the heat transfer tube 61*a*1 of the first group is the same as the inner diameter Do2 of the heat transfer tube 24*a* of the outdoor heat exchanger 24. For another example, (i) the inner diameter of each heat transfer tube of the first group may be larger than that of each heat transfer tube of the outdoor heat exchanger and (ii) the outer diameter of the heat transfer tube of the first group may be smaller than the outer diameter Do1 of the heat transfer tube of the outdoor heat exchanger. Alternatively, (i) the inner diameter of the heat transfer tube of the first group may be larger than that of each heat transfer tube of the second group and (ii) the outer diameter of the heat transfer tube of the first group may be smaller than that of the heat transfer tube of the second group.

The air conditioner of each of First to Fourth Embodiments described above includes the air supply duct configured to allow the outdoor air to flow toward the indoor unit. However, the air conditioner of each of these Embodiments may not include the air supply duct. In this case, all heat transfer tubes of the indoor heat exchanger may be the same as the heat transfer tubes of the first groups in each of these Embodiments described above. In each of First to Third Embodiments described above, the humidification unit 5 includes the moisture-absorbing rotor, the heater assembly, the humiliation fan, and the absorption fan. However, the humidification unit 5 may be an air supply unit used for supplying the outdoor air to the room. The air supply unit includes an air supply fan. The humidification unit and the air supply unit may be provided on the refrigerant unit 4 or may be provided separately from the outdoor unit.

The thickness of the sacrificial layer formed on each heat transfer tube of the first group of the indoor heat exchanger may be zero. The present disclosure is applicable to a microchannel heat exchanger including a heat transfer tube made of aluminum or aluminum alloy. The present disclosure is also applicable to an outdoor air processor configured to condition and supply outdoor air to a room.

In another perspective, the air conditioner of the present disclosure is configured to condition air by connecting the following units to each other: the indoor unit including a first heat exchanger in which a refrigerant exchanging heat with the room air flows; the outdoor unit including a second heat exchanger in which a refrigerant exchanging heat with the outdoor air flows. The first heat exchanger includes a first heat transfer tube, and the second heat exchanger includes a second heat transfer tube. Furthermore, a coating is formed on a first fin in contact with an outer circumferential surface of the first heat transfer tube, and a coating is formed on a second fin in contact with an outer circumferential surface of the second heat transfer tube. A first sacrificial layer and a second sacrificial layer may not be formed on the first heat transfer tube and the second heat transfer tube. The thickness of the coating formed on the second fin is preferably larger than that of the coating formed on the first fin. The first fin and the second fin are preferably made of aluminum or aluminum alloy. The first sacrificial layer and the second sacrificial layer are preferably formed on the first heat transfer tube and the second heat transfer tube.

In each of Embodiments described above, the thickness of the sacrificial layer formed on the outer circumferential surface of the heat transfer tube of each heat exchanger may vary depending on a position in the heat exchanger. In the heat exchanger, for example, the thickness of one part of the sacrificial layer is preferably larger than that of another part of the sacrificial layer. In this regard, the air speed is high at one part of the sacrificial layer and low at another part thereof. To an area where the air speed is high, the large number of chloride ions accelerating the corrosion adheres so that the corrosion easily progresses. The thickness of the sacrificial layer is therefore arranged to vary depending on the position in the heat exchanger as described above so that the corrosion of the heat transfer tube is suppressed in accordance with the distribution of air speed. This arrangement to vary the thickness of the sacrificial layer in accordance with the distribution of air speed is applicable to both of the indoor heat exchanger and the outdoor heat exchanger. Furthermore, this arrangement is applicable to a case where, in each of First to Fourth Embodiments, (i) the air supply duct 8 is not provided and (ii) only the heat transfer tube of the first group is formed in the indoor heat exchanger. In another perspective, the air conditioner of the present disclosure includes a heat exchanger, the heat exchanger includes a first heat transfer tube and a second heat transfer tube which are made of aluminum or aluminum alloy, the air speed at the first heat transfer tube is lower than that at the second heat transfer tube, a first sacrificial layer is formed on an outer circumferential surface of the first heat transfer tube, a second sacrificial layer is formed on an outer circumferential surface of the second heat transfer tube, and the maximum thickness of the second sacrificial layer is larger than that of the first sacrificial layer.

Although Embodiments have been described above, it will be understood that various changes in form and details are possible as long as the changes do not depart from the spirit and scope of the claims.

REFERENCE SIGNS LIST

1 air conditioner
2 indoor unit
3 outdoor unit
4 outdoor refrigerant unit
5 humidification unit
8 air supply duct
8*a* opening
11 indoor heat exchanger
11*a* heat transfer tube
11*a*1 heat transfer tube of first group
11*a*2 heat transfer tube of second group
11*b* U-bend
11*c* fin
24 outdoor heat exchanger
24*a* heat transfer tube
24*b* U-bend
24*c* fin

34, 44*a*, 44*b* base material

35, 45*a*, 45*b* sacrificial layer

The invention claimed is:

1. An air conditioner comprising:

an indoor unit including a first heat exchanger, in which a refrigerant exchanging heat with room air flows; and an outdoor unit including a second heat exchanger in which a refrigerant exchanging heat with outdoor air flows, the indoor unit and the outdoor unit connected with each other to condition air, the first heat exchanger including a plurality of first heat transfer tubes made of aluminum or aluminum alloy, the second heat exchanger including a plurality of second heat transfer tubes made of aluminum or aluminum alloy, all of the first heat transfer tubes including first sacrificial layers formed on outer circumferential surfaces of the first heat transfer tubes, all of the first heat transfer tubes including second sacrificial layers formed on outer circumferential surfaces of the second heat transfer tubes, and all of the thicknesses of the second sacrificial layers being larger than any of the thicknesses of the first sacrificial layers.

2. The air conditioner according to claim 1, wherein, wall thicknesses of the first heat transfer tubes are smaller than wall thicknesses of the second heat transfer tubes.

3. The air conditioner according to claim 1, wherein, inner diameters of the first heat transfer tubes are larger than inner diameters of the second heat transfer tubes.

4. The air conditioner according to claim 1, wherein, outer diameters of the first heat transfer tubes are smaller than outer diameters of the second heat transfer tubes.

5. The air conditioner according to claim 1, wherein, the first sacrificial layers and the second sacrificial layers are made of zinc or alloy including zinc.

6. The air conditioner according to claim 1, wherein, a maximum thickness of the first sacrificial layers are 0.12 mm or more.

7. The air conditioner according to claim 1, wherein, a maximum thickness of the second sacrificial layers are 0.17 mm or more.

8. The air conditioner according to claim 1, wherein, the first heat transfer tubes are formed of: a base material made of aluminum or aluminum alloy; and the first sacrificial layers, the second heat transfer tubes are formed of: another base material made of aluminum or aluminum alloy; and the second sacrificial layers, and each of the first heat transfer tubes and the second heat transfer tubes is formed of a clad material.

9. The air conditioner according to claim 1, wherein, the first heat transfer tubes are formed of: a base material made of aluminum or aluminum alloy; and the first sacrificial layers, the second heat transfer tubes are formed of: another base material made of aluminum or aluminum alloy; and the second sacrificial layers, and each of the first sacrificial layers and the second sacrificial layers is a diffuse layer made of aluminum-zinc alloy.

10. The air conditioner according to claim 1, further comprising an air supply duct configured to allow the outdoor air to flow toward the indoor unit, wherein, the first heat exchanger further includes a third heat transfer tube made of aluminum or aluminum alloy, a third sacrificial layer is formed on an outer circumferential surface of the third heat transfer tube, a maximum thickness of the third sacrificial layer is larger than a maximum thickness of the first sacrificial layers, and the third heat transfer tube is closer to an opening of the air supply duct than the first heat transfer tubes are to the opening.

11. The air conditioner according to claim 10, wherein, the wall thickness of each of the first heat transfer tubes is smaller than the wall thickness of the third heat transfer tube.

12. The air conditioner according to claim 10, wherein, inner diameters of the first heat transfer tubes are larger than an inner diameter of the third heat transfer tube.

13. The air conditioner according to claim 10, wherein, outer diameters of the first heat transfer tubes are smaller than an outer diameter of the third heat transfer tube.

14. The air conditioner according to claim 10, wherein, the maximum thickness of the third sacrificial layer is the same as the maximum thickness of the second sacrificial layers.

15. The air conditioner according to claim 10, wherein, the second sacrificial layers, the third sacrificial layer, and the first sacrificial layers in this order are the largest, the second largest, and the third largest in maximum thickness.

16. The air conditioner according to claim 1, wherein, a coating is formed on a first fin in contact with the outer circumferential surface of at least one of the first heat transfer tubes, and another coating is formed on a second fin in contact with the outer circumferential surface of at least one of the second heat transfer tubes.

17. The air conditioner according to claim 16, wherein, the thickness of the another coating formed on the second fin is larger than the thickness of the coating formed on the first fin.

* * * * *